US006109734A

United States Patent [19]

Kashino et al.

[11] Patent Number: 6,109,734

[45] **Date of Patent: *Aug. 29, 2000**

[54] INK-JET HEAD, INK-JET APPARATUS AND METHOD OF FILLING BUFFER CHAMBER WITH BUBBLES

[75] Inventors: Toshio Kashino, Chigasaki; Ishigorou Takahashi, deceased, late of Sakata, by Hiroto Takahashi, legal representative; Hiroyuki Ishinaga, Tokyo; Eiichiro Shimizu, Urawa; Keisuke Matsuo, Yokohama; Yoshinori Misumi, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/451,762

[22] Filed: May 26, 1995

[30] Foreign Application Priority Data

| | | | |
|---|---|---|---|
| May 27, 1994 | [JP] | Japan | 6-115128 |
| Jul. 28, 1994 | [JP] | Japan | 6-176653 |
| Nov. 10, 1994 | [JP] | Japan | 6-276549 |

[51] Int. Cl.[7] ..... B41J 2/05

[52] U.S. Cl. ..... 347/65; 347/67; 347/92; 347/94

[58] Field of Search ..... 347/65, 67, 92, 347/94, 84, 56, 54, 20, 1

[56] References Cited

U.S. PATENT DOCUMENTS

| | | | |
|---|---|---|---|
| 4,646,110 | 2/1987 | Ikeda et al. | 347/56 |
| 4,905,019 | 2/1990 | Vonasek | 346/75 |
| 4,994,825 | 2/1991 | Saito et al. | 346/140 R |
| 5,021,809 | 6/1991 | Abe et al. | 346/56 |
| 5,107,281 | 4/1992 | Takahashi | 346/140 R |
| 5,175,565 | 12/1992 | Ishinaga et al. | 346/140 R |
| 5,208,604 | 5/1993 | Watanabe et al. | 346/1.1 |
| 5,389,957 | 2/1995 | Kimura et al. | 347/20 |
| 5,682,190 | 10/1997 | Hirosawa et al. | 347/94 |

FOREIGN PATENT DOCUMENTS

| | | | |
|---|---|---|---|
| 419181 | 3/1991 | European Pat. Off. | 347/65 |
| 0496533 | 7/1992 | European Pat. Off. . | |
| 0562733 | 9/1993 | European Pat. Off. . | |
| 0591989 | 4/1994 | European Pat. Off. . | |
| 0594110 | 4/1994 | European Pat. Off. . | |
| 362212157 | 9/1987 | Japan | 347/48 |

*Primary Examiner*—John Barlow
*Assistant Examiner*—Juanita Stephens
*Attorney, Agent, or Firm*—Fitzpatrick, Cella, Harper & Scinto

[57] ABSTRACT

An ink jet head having a buffer chamber which absorbs any back-pressure wave generated as a result of generation of back wave, thereby preventing reduction of refilling with ink. Exothermic elements provided in buffer chambers formed in a common ink chamber generate bubbles so that bubbles are always maintained in the buffer chambers so as to ensure stable recording.

16 Claims, 16 Drawing Sheets

INK-JET HEAD, INK-JET APPARATUS AND METHOD OF FILLING BUFFER CHAMBER WITH BUBBLES

BACKGROUND OF THE INVENTION

1. Field of the Invention

The present invention relates to an ink-jet recording head for performing recording on a recording medium by discharging ink onto the medium from the recording head. The invention also relates to an ink-jet recording apparatus using the recording head. The term "recording" throughout this specification is used in the sense that ink or the like is provided (printing) for all materials which can accept ink thereon (recording media), such as cloth, paper, yarn, sheet materials and the like. The present invention is applicable to these uses.

2. Related Background Art

Among currently known various recording methods, an ink-jet recording method, which is a non-impact recording method producing very little noise during recording, is known to be extremely effective since it is possible to perform high-speed recording without requiring specific ink-fixing on ordinary paper.

FIGS. 1 and 2 schematically illustrate the construction of a typical ink-jet head used in such an ink-jet recording method. FIG. 1 is an outer perspective view, and FIG. 2 is a perspective view showing the interior construction.

The ink-jet head shown in FIGS. 1 and 2 includes a base plate 200 used for constructing respective components (described below) to be formed thereon, and an element substrate (hereinafter referred to as "the heater board") 100 disposed on the base plate 200, the heater board being provided with a plurality of electro-thermal transducers (heaters) 101 used as discharging-energy generating elements. Ink channels 303 corresponding to a plurality of respective ink-discharge openings 301 are formed on the heater board 100. A grooved member (a top plate 300) having a plurality of grooves therein for forming the above-mentioned ink channels is bonded to a predetermined position of the heater board 100. The top plate 300 has an orifice plate 304 having the ink-discharge openings 301 formed therethrough, a recess for forming a common liquid chamber 302 for storing ink to be supplied to the ink channels 303, and a cylindrical ink-filling opening 305 through which ink is supplied into the chamber 302. The above-described bonding of the top plate 300 onto the heater board 100 is carried out by the following process. For bonding the top plate 300 to the heater board 100, the top plate 300 is first allowed to temporarily adhere to the board 100 in such a manner that a plurality of heaters 101 can correspond to the respective ink-discharge openings 301. Then, mechanical pressure is applied to the top plate 300 from above by an urging spring (not shown), thus obtaining a sufficiently intimate connection therebetween. Subsequently, the top plate 300 and the heater board 100 are sealed therearound by a sealing agent 400, as shown in FIG. 7, and whereby the ink channels 303 and the common liquid chamber 302 are hermetically cut off from the exterior.

The generation of the pressure required for discharging ink in the ink-jet recording head results from the fact that thermal energy generated in the heaters 101 acts on the ink flowing in the ink channels 303 to induce film boiling, which further produces bubbles. The thus-generated pressure is transferred in the direction of the ink-discharge openings 301 through the ink flowing in the channels 303 and also in the direction of the common liquid chamber 302, the two directions being opposite to each other.

The ink flowing in the channels 303 is squeezed out from each of the discharge openings 301 by the action of the pressure transferred to the discharge opening 301 so as to form flying discharge droplets. At the time when the ink is formed into a discharge droplet which then departs from the discharge opening 301, the meniscus formed on the surface of the ink at each opening 301 recedes according to the amount of droplet. By the action of the tension for pulling back the meniscus in the direction of the discharge opening 301, the ink is again filled in the ink channel after a lapse of a certain time as it has been before discharging. Such a phenomenon is referred to as "refilling". In the actual recording operation, the above-described process is repeated while good condition of refilling is ensured, thereby achieving continuously stable ink discharging.

In order to cope with recent trends towards an increased amount of discharging ink and higher printing speed, a large amount of ink is discharged for a short time, and accordingly, refilling should be performed at higher speed. However, conventional heads often fail to perform stable refilling in the above background, which brings about unstable ink discharging and further causes a deterioration in printing quality. Further, there arises a disparity between the amount of ink discharged for the first time after recording has been started and the amounts of ink for subsequent numbers of discharging time, which may disturb a resultant recorded image.

It is considered that the above-mentioned drawbacks originate from pressure waves (back waves) transferred in the direction opposite to that of the ink-discharge openings.

Such pressure waves impede the ink from flowing into the ink channels, thus making it difficult to perform refilling at higher speed.

Also, for the same reason, there disadvantageously arises a disparity between the amount of discharging ink for the first time after recording has been started, which discharging operation is free from the effect of the back waves, and the amounts of ink for subsequent number of times, which discharging operations are adversely influenced by the back waves.

One of the measures to effectively reduce the influences of the pressure waves is a small chamber (hereinafter referred to as "a buffer chamber" or "a bubble cell") which is communicated only to the common liquid chamber and contains bubbles (gas) for eliminating the pressure of the back waves, as disclosed in Japanese patent Application Laid-Open No. 1-308644.

Since this small chamber is communicated to the common liquid chamber through a very small communicating portion, it is formed in such a shape that it is very difficult for ink to enter. With this construction, a gas is likely to be constantly present in the small chamber and functions to eliminate pressure fluctuations caused by the back waves produced during the ink discharging, thus obtaining stable refilling and further achieving excellent high-speed printing.

In order to remove bubbles entering the ink channels (flow channels) and also to obviate thickened ink within the flow channels in the vicinity of the discharge openings, a recovering operation by vacuum suction is performed to such and discharge the ink to the exterior from the discharge openings.

However, when this recovering operation is performed on a head provided with the above-described small chamber, a considerable amount of gas is inevitably vented from the chamber, thus disadvantageously reducing the effect of eliminating the pressure of the back waves.

In order to overcome the above drawback, the communicating portion leading to the common liquid chamber may be formed in a more complicated shape so that bubbles can be prevented from being vented from the chamber even by performing this recovering operation. However, this makes it difficult to manufacture such a chamber and also conversely may weaken the effect of eliminating the pressure of the back waves.

Additionally, in order to ensure the stable function of the buffer chamber after the recovering operation, it is necessary to form the buffer chamber with a large volume to such a degree that some bubbles can still remain even after a certain amount of bubbles are vented from the chamber.

In general, it is necessary that the amount of ink (suction amount) required for the above-described ink discharging be larger than the total of the volume of the common liquid chamber including the buffer chamber and that of the ink channels. Thus, the larger the buffer chamber, the larger the amount of discharging ink required. This necessitates a larger volume pump for use in the suction operation and also gives rise to an increase in the amount of ink which cannot be discharged, but instead should be exhausted.

In the ink-jet recording head, if bubbles, such as air, are present in the ink flowing from the common liquid chamber 302 to the ink-discharge opening 301 without performing ink discharging for a long period of time, the bubbles may gradually grow with a lapse of time to disturb the flow of ink and further inhibit the ink from being discharged. In order to avoid such a situation, the ink-jet recording apparatus usually performs a recovering operation for sucking the ink at regular intervals to remove the bubbles.

The same also applies to the air within the buffer chamber. That is, if the buffer chamber is left for a long period of time without performing ink discharging, the air causes bubbles to grow and to reach the ink channels, which may further prevent the ink from being discharged. For this reason, the buffer chamber is located in the farthest-possible position away from the ink-discharge openings 301.

However, heater boards are becoming smaller to be adaptable for smaller-sized ink-jet recording heads and also to decrease the cost. Along with such downsizing of the board, the buffer chamber is required to be placed in the vicinity of the ink-discharge openings 301. This may cause the bubbles which have grown to reach the portion near the ink-discharge openings from the buffer chamber between the recovering operations, thus resulting in a failure in discharging the ink. In addition, since the volume of the common liquid chamber 302 is becoming smaller to be adaptable for the downsizing of the heater board, a small amount of bubbles stored in the common liquid chamber 302 may reach the portion near the ink channel, thus also bringing about a failure in discharging the ink.

SUMMARY OF THE INVENTION

Accordingly, in order to solve the above-described various problems, an object of the present invention is to provide an ink-jet head, an ink-jet head cartridge, an ink-jet head kit, an ink-jet apparatus, all of which are able to perform stable recording without an impairment of the effect of a buffer chamber even though a gas is vented from the chamber by a discharge recovering operation, and also to provide a method of filling bubbles in the buffer chamber.

Another object of the present invention is to provide an ink-jet head and the like in which possible bubbles growing in the buffer chamber are unlikely to reach a flow channel so that no adverse effect will be produced during recording.

A further object of the present invention is to provide an ink-jet head and the like which can be constructed inexpensively and yet achieve stable high-speed recording.

According to one aspect of the present invention, there is provided an ink-jet head for performing recording by discharging an ink, comprising: discharge openings through which the ink is discharged; ink flow channels corresponding to the discharge openings, each of the ink flow channels having a discharge energy acting portion in which discharge energy for discharging the ink acts on the ink; a common liquid chamber for commonly supplying the ink flow channels with the ink; a buffer chamber communicating only with the common liquid chamber, the buffer chamber preserving bubbles therein; and bubble generating means provided correspondingly to the buffer chamber.

According to another aspect of the invention, there is provided an ink-jet head for performing recording by discharging an ink, comprising: an element substrate having discharge energy generating elements for discharging the ink and disposed correspondingly to ink flow channels, the element substrate further having bubble generating means for generating bubbles to be preserved in buffer chambers; and a grooved member integrally having discharge openings through which the ink is discharged, grooves constituting the ink flow channels, a recess partly defining a common liquid chamber for commonly supplying the ink flow channels with the ink, and a recess defining a buffer chamber for preserving bubbles and communicating only with the common liquid chamber; the ink-jet head being formed by jointing the element substrate and the grooved member to each other.

The invention also provides an ink jet head cartridge comprising a head of either one of the above-mentioned types, and an ink container holding ink to be supplied to the head.

The invention also provides an ink jet apparatus comprising a head of either one of the above-mentioned types, and an activating means for activating the bubble generating means.

The invention further provides an ink jet head kit comprising a head of either one of the above-mentioned types, an ink container holding ink to be supplied to the head, and ink refilling means for refilling the ink container with the ink.

According to a further aspect of the invention, there is provided, in a system having ink flow channels corresponding to ink discharge openings, a common liquid chamber for supplying the ink flow channels with ink, and a buffer chamber communicating only with the common liquid chamber and preserving bubbles therein, a method of filling the buffer chamber with the ink, comprising the steps of: inducing the ink out through the discharge openings by externally applying suction vacuum; and activating, after the induction of the ink and before the recording, bubble generating means provided correspondingly to the buffer chamber so as to generate bubbles, thereby filling the bubble chamber with the bubbles.

Further objects, features and advantages of the present invention will become apparent from the following description of the preferred embodiments with reference to the attached drawings.

DETAILED DESCRIPTION OF THE PREFERRED EMBODIMENTS

Figure 1:
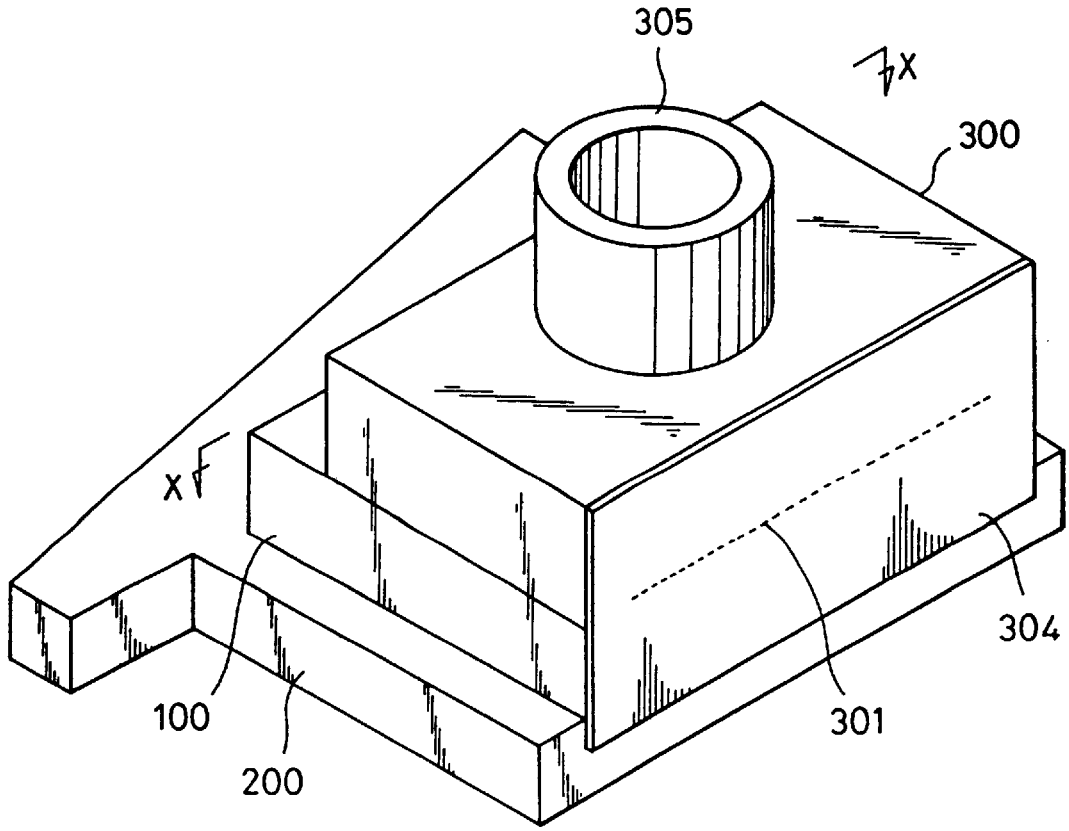
FIG. 1 PRIOR ART
FIG. 1 is an outer perspective view illustrative of a typical conventional ink-jet head.
Figure 2:
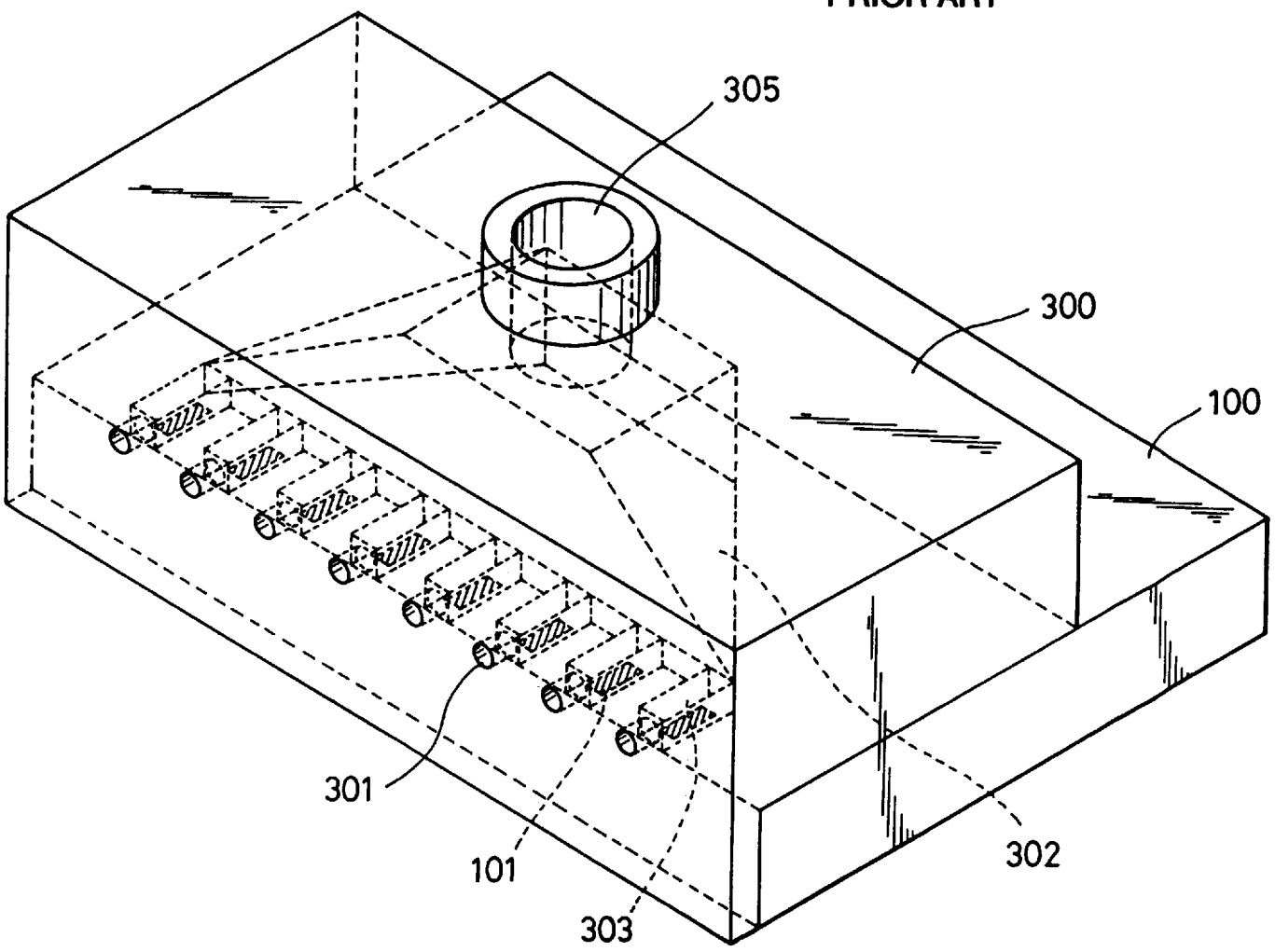
FIG. 2 PRIOR ART
FIG. 2 is a perspective view showing the interior construction of a typical conventional ink-jet head.
Figure 3:
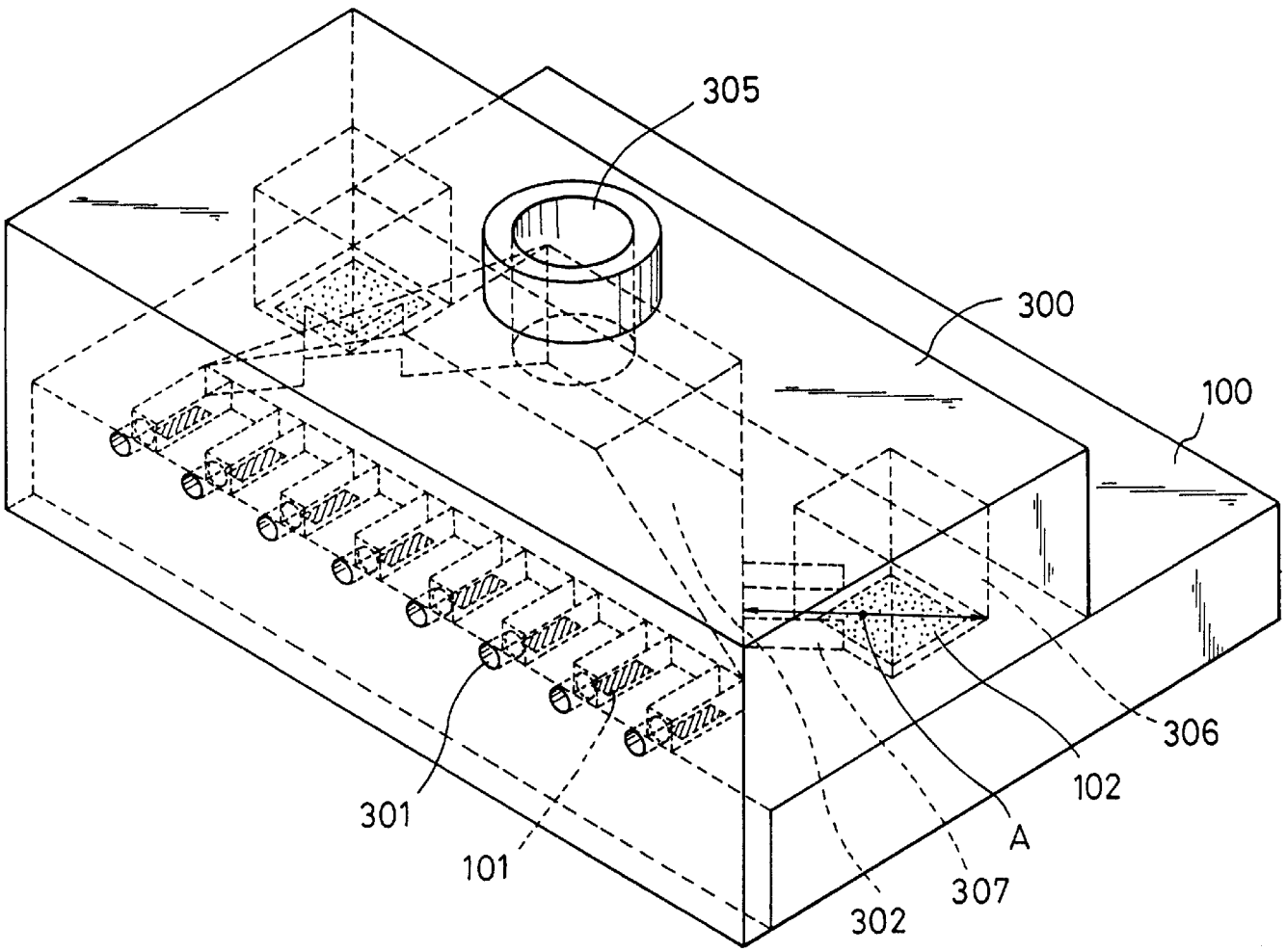
FIG. 3 is a schematic perspective view illustrative of an ink-jet head of the present invention.

FIG. 1 is a perspective view schematically illustrating an ink-jet head comprising a grooved member (a grooved top plate or a recessed top member) 300, and a heater board 100 provided with a plurality of energy-generating element for effecting ink discharging. The grooved top plate 300 further includes an orifice plate 304 shown in FIG. 4, a plurality of grooves for forming ink channels, a recess for forming a common liquid chamber 302 used for storing ink to be supplied to the ink channels, and a recess for forming a buffer chamber communicated only to the common liquid chamber, all the components being integrally formed into the top plate 300. FIG. 2 is a perspective view of the top plate 300 as viewed from the reverse side. Referring to FIGS. 1, 2 and 3, the top plate 300 comprises ink-discharge openings (orifices) 301 formed by boring holes through the orifice plate having a maximum thickness of 200$\mu$m, a buffer chamber 306 for holding bubbles (gas) therein, and an ink-filling opening 305 through which ink is supplied to the common liquid chamber 302, the opening 305 being formed by bonding the top plate 300 to the heater board 100. The heater board 100 has heater portions 101 of electro-thermal transducers mounted thereon used as elements for generating thermal energy, which is one type of discharging energy employed in ink discharging. The board 100 also has bubble (gas)-generating means 102 held by the buffer chamber 306. In this embodiment, electro-thermal transducing elements, which generate bubbles by heating ink, are employed as the bubble-generating means 102.

As described above, electro-thermal transducers are used both for the bubble-generating means and the discharging-energy generating elements for effecting ink discharging.

The electro-thermal transducers each have a resistance layer formed of hafnium boride, tantalum nitride or the like, and wiring through which electric signals are transmitted. A protective layer formed of silicon oxide, silicon nitride, tantalum, tungsten or the like, may be further deposited on the resistance layer as required to protect the wiring and a heat-emitting portion (heater portion) of the resistance layer from ink.

Elements such as piezoelectric elements and the like may be used as the discharging-energy generating elements. However, electro-thermal transducers are more dominant over the piezoelectric elements for the discharging-energy generating elements, as used in this embodiment, because then, the energy-generating elements can be formed of a resistance layer using the same material as that of the bubble-generating means, which further makes it possible to provide an ink-jet head with a simple manufacturing process.

Also, when the electro-thermal transducers are employed, a process of producing bubbles by the discharging-energy generating elements should be different from that by the bubble-generating means.

With regard to bubbles produced by the discharging-energy generating elements, it is required that the process of generating, growing and collapsing bubbles be accomplished at high speed since ink should be repeatedly discharged from the discharge openings at high speed.

In contrast, concerning bubbles produced by the bubble-generating means, it is necessary that the bubbles have a long collapsing time because they should remain in the buffer chamber for a long period.

In order to realize the generation of the two types of bubbles, the discharging-energy generating means heats the ink to induce film boiling thereon, while the bubble-generating means heats the ink to bring about nucleate boiling therein.

For achieving the respective types of boiling, the heating temperature should be raised more slowly in the bubble-generating means than the discharging-energy generating means, which can be effectively achieved by means such as making adjustments to electric signals applied to the elements and the means or by depositing a partially-opened tantalum-formed protective layer on the bubble-generating means so as to control the occurrence of the nucleate boiling.

The buffer chamber of the embodiment has a communicating path (or a communicating vent) 307. This communicating path 307 has a smaller sectional area than that of the buffer chamber and than that of the common liquid chamber. In other words, the communicating path is formed in a narrower shape than the surrounding components. With this construction, bubbles within the buffer chamber can be protected from being easily vented to the common liquid chamber. In this embodiment, with a view to preventing easy venting of the bubbles and obtaining the buffering effect, the height of the communicating path is set to be in a range of from one sixth to one half of the height of the liquid chamber, and more preferably, in a range of from one fifth to one third.

Also, even though the bubbles within the buffer chamber are exhausted induced by the exhaustion of the ink flowing in the ink channels and ink stored in the common liquid chamber through the discharge openings, bubbles can be refilled by the bubble-generating means, thereby maintaining the buffering effect.

Moreover, the buffer chamber is constructed in such a manner that bubbles can be protected from being vented from the chamber even by the discharge recovering operation, which construction does not yet make the manufacturing process complex nor does it decrease the buffering effect.

Further, in this embodiment, the bubble-generating means is placed substantially at the center of the buffer chamber. More specifically, the bubble-generating means is placed to include the center (the position A in FIG. 3) but to be farther away from the communicating path with respect to the center, thus protecting the bubbles which have just been produced from being vented to the common liquid chamber.

This embodiment may be constructed in such a way that the heater of the bubble-generating means doubles as a temperature-adjusting heater for heating (indirect heating) the ink in the common liquid chamber.

As has been discussed above, the bubbles within the buffer chamber may be disadvantageously vented partially or entirely therefrom during the discharge recovering operation by vacuum suction or during the other occasions, depending on the configuration of the buffer chamber. That is, if the bubbles within the common liquid chamber and the buffer chamber are completely vented therefrom, the refill required between the first and second discharging times in the continuous discharging operation is delayed, and accordingly, an ink droplet cannot be formed properly at the second discharging time, thereby further incurring a deterioration in image quality. For solving the above-mentioned problem, in this embodiment, the following control is added to improve the buffering effect and to enhance the reliability of the head. That is, based on the fact that bubbles within the common liquid chamber are eliminated by the discharge recovering operation, bubbles in a suitable size, which can exert the buffering effect without producing any adverse influence on the discharge operation, will thus be formed in the buffer chamber after completion of the suction process of the discharge recovering operation under the control of the volume, size and the other conditions of the bubbles.

An explanation will now be given of an embodiment in which bubbles are produced in the buffer chamber.

Since the amount of discharging droplets varies according to the temperature of an ink-jet print head, the print head usually has a temperature-adjusting heater which is different from an ink-discharging heater and is used as means for stabilizing the discharging amount by heating the print head and keeping it warm (hereinafter referred to as the sub-heater.

In this embodiment, the heater of the bubble-generating means doubles as the temperature-adjusting heater. For generating bubbles serving as a buffer, after performing the recovering operation the bubble-generating means can be turned on to produce bubbles in the buffer chamber.

Figure 5:
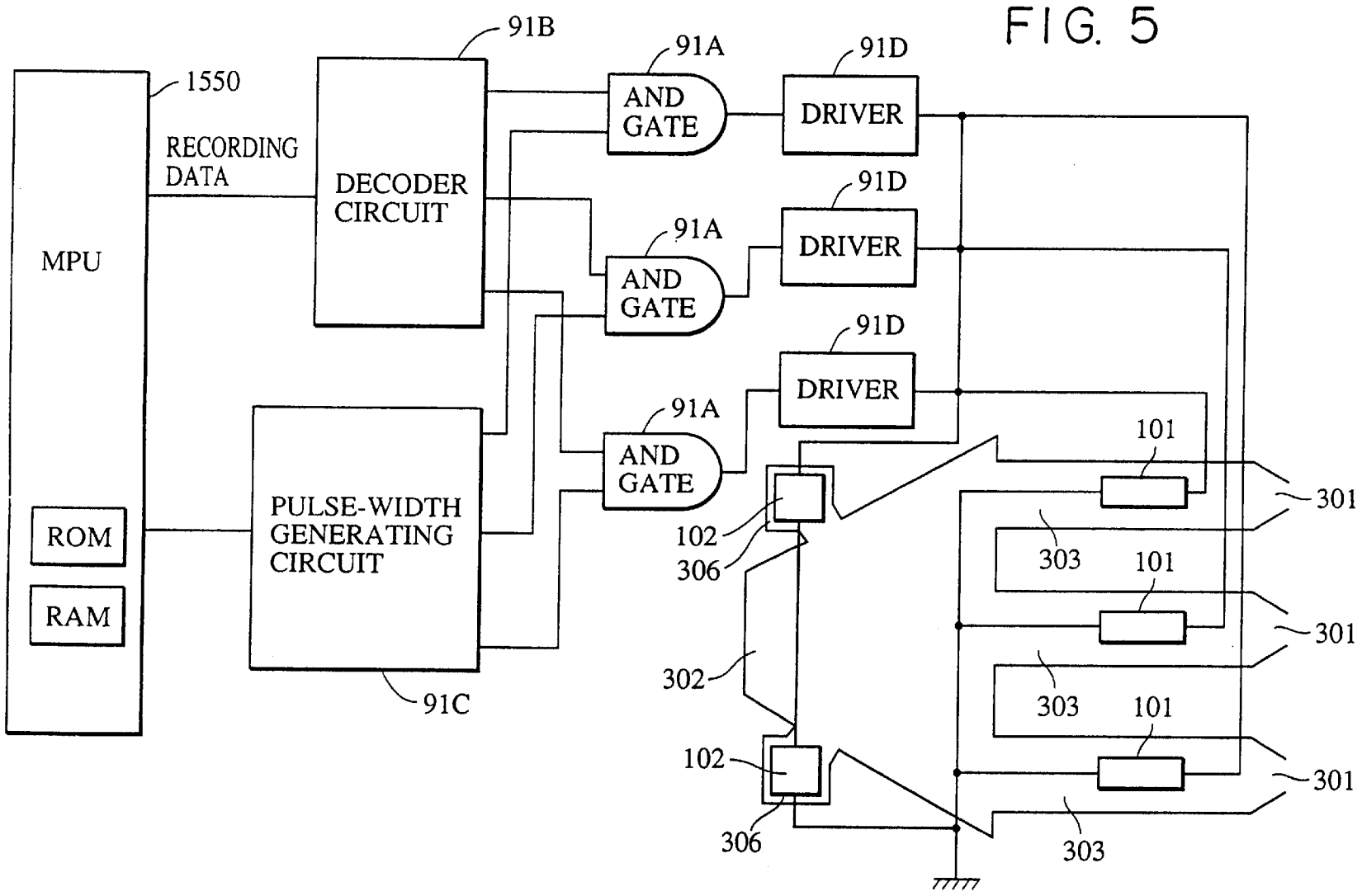
FIG. 5 is a drive circuit for a print head according to a first embodiment of the present invention.

FIG. 5 is a block diagram illustrative of one example of the construction of the drive control for driving the discharging heater or the sub-heater. Only three of the discharge openings 301 and the three corresponding discharging heaters 101, as well as other components, are shown in this figure, and remaining components are omitted.

A pair of buffer chambers 306 communicated to the flow channels 303 and the common liquid chamber 302 are each provided with the above-described discharging heaters 101 and the ink temperature-adjusting sub-heater 102. Drivers 91D are respectively provided for driving these heaters. The discharging heater 101 can be driven by the following process. Based-on the pulse-width data output from a MPU (microprocessor unit) 1550, a pulse-width signal is generated in a pulse-width generating circuit 91C. A discharge signal is generated in a decoder circuit 91B based on print data (discharge data) output from the MPU 1550. The pulse-width signal and the discharge signal are processed in an AND gate 91A, thus driving the discharging heater 101. This process can differentiate the pulse width and the drive frequency employed for ink discharging from those for the generation of bubbles, as has been discussed above.

Suitable energy required for supplying necessary bubbles to the buffer chamber varies depending on the environmental temperature in which the print head is placed and the temperature of the head itself (ink temperature), including a temperature rise caused by printing. Based on this fact, there is provided means for detecting the environmental temperature and the temperature of the print head so as to vary the amount of energy which should be applied for the generation of the bubbles.

Additionally, in the foregoing respective embodiments, bubbles have been produced in the buffer chamber at the timing after the bubbles within the common liquid chamber had been exhausted by the discharge recovering operation. More specifically, bubbles are best produced immediately after the discharge recovering operation and immediately before the printing operation in order to achieve the reliable generation of the bubbles which can fully exert the above-described buffering function relative to ink discharging necessitated by printing, and also to enhance easy control of the size of the bubbles. However, if printing is not carried out for a long period of time, bubbles may be mixed into the ink channels and the buffer chamber and gradually grow to become considerable in size. In particular, in the buffer chamber formed in a tapered shape, the bubbles may be compacted to grow to a bubble similar to those shown in the above-described embodiments. The experiment shows that it takes approximately one second to produce 1 $\mu$m-bubbles and three days to produce 100 $\mu$m-bubbles for such naturally-generated bubbles. After a printer has been left for a long period, bubbles in the buffer chamber may grow therein, as has been discussed above. In this case, if the size of such bubbles is checked by experiment or other means in advance, the heating means may be driven immediately before printing according to their size so that resultant bubbles may be in a desired size.

A description will now be given of the construction of an ink-jet head which has been further improved in accordance with the present invention. In some cases, tiny bubbles resident in the ink flow channels and in the common liquid chamber remain without being discharged or collapsed even after printing, so as to form a bubble which has a certain size and which stagnates in the common liquid chamber. Bubble or bubbles in the common liquid chamber do not always cause serious effect. However, existence of too many bubbles or a bubble of a too large volume causes problems such as a change in the direction or quantity of the ink-jet and blockage of the flow channel with the bubble which results in a discharge failure. It is therefore preferred that the bubbles stagnant in the common liquid chamber are removed as much as possible by a discharge recovery operation which is executed in the event of a discharge failure, the discharge recovery being effected by vacuum suction in this embodiment.

In order to ensure that bubbles hampering the safe discharge can efficiently be removed by the recovery operation, the common liquid chamber 302 in the ink-jet head of this embodiment has a triangular sectional form and a slant surface is provided to extend between a position near an ink filling port 305 and ink channels leading to discharge openings of the orifices. In order to uniformly suck the ink from all portions of the common ink chamber so as to remove stagnant bubbles, it is necessary that the wall surfaces of the common liquid chamber are smoothly configured in conformity with the flow of the ink which is being sucked. Thus, triangular configuration is preferred to rectangular shape having corners, since such a triangular configuration minimizes the length of travel of the ink to the flow channels.

It is thus possible to efficiently remove bubbles which hamper safe discharging of the ink from the ink-jet head. The buffer chamber, which is intended to contain a bubble of a volume to achieve optimum buffering effect, is arranged perpendicularly to the surface of the wall defining each oblique side of the triangular configuration of the common liquid chamber. When the ink is sucked, stagnation of ink takes place in the recess formed in such a wall surface. Any bubble or bubbles in the recess also remain without being discharged.

Figure 4:
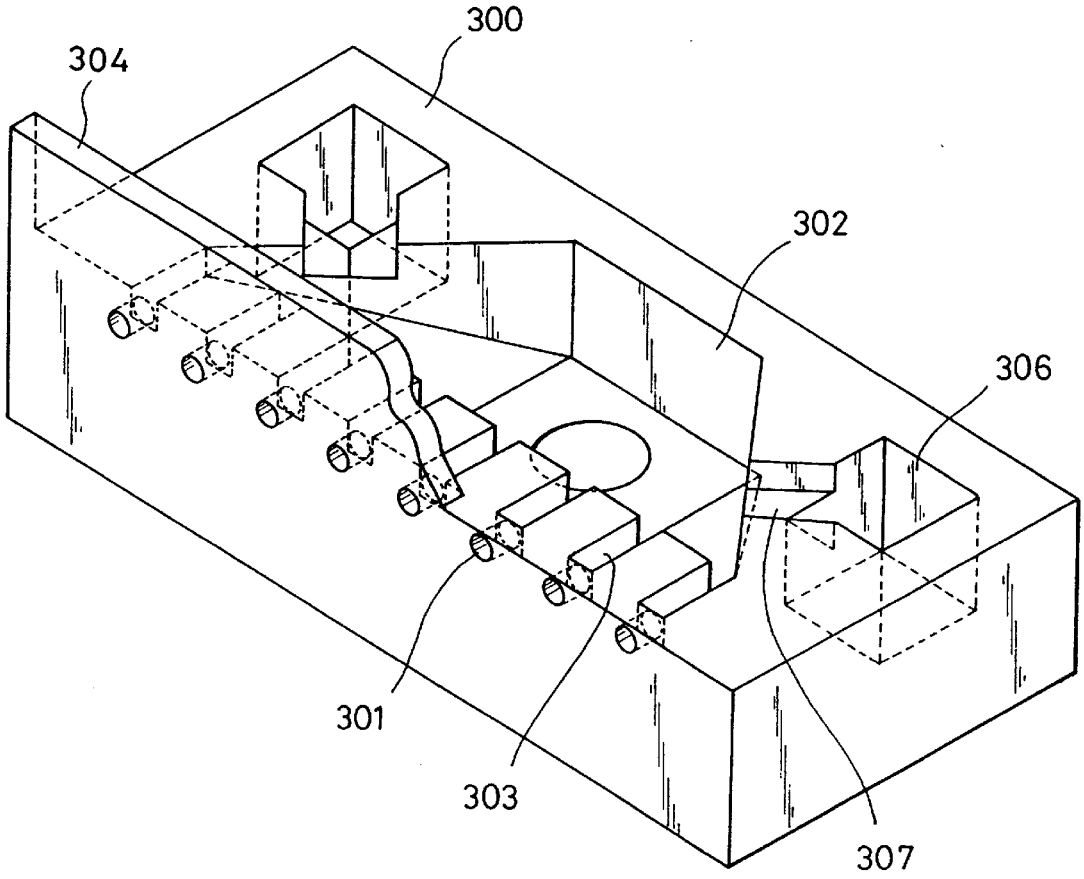
FIG. 4 is a partially cutaway view illustrative of a grooved member of the present invention as viewed from the reverse side thereof.

The present invention makes an effective use of these characteristics. Namely, according to the present invention, buffer chambers 306 communicating with the common liquid chamber 302 are formed in the top panel 300. This structure is extremely simple as illustrated in FIG. 4 and can easily be formed by molding.

The configurations and arrangements of the common liquid chamber 302 and buffer chambers as described ensure that bubbles which have been introduced into and dispersed in the common liquid chamber 302 are concentrated, so that the bubbles, which hamper jetting of the ink, can easily be discharged from the discharge openings due to the flow of the ink caused by the discharge recovery operation, while ensuring that suitable volumes of bubbles are maintained in the buffer chambers, thereby eliminating problems such as printing failure or shortening of the life of the print head which are liable to occur due to stagnation of bubbles in the common liquid chamber.

As will be understood from the foregoing description, in this embodiment of the present invention, the bubble generating means provided in the buffer chamber generates bubbles to make up for any shortage of the bubble volume. Thus the present invention provides a construction which enables easy removal of bubbles from the common liquid chamber and the flow channels by the sucking recovery operation, without allowing escape of bubble from the buffer chambers.

A description will now be given of the construction of an ink-jet head which is improved to eliminate undesirable effect caused on the ink flow channels by growth of bubbles in the buffer chambers.

The construction of the heater board and the whole structure of the head are not described because they are materially the same as those of the embodiment described before. The description will proceed with specific reference to FIG. 6, as well as to FIG. 3.

Figure 6:
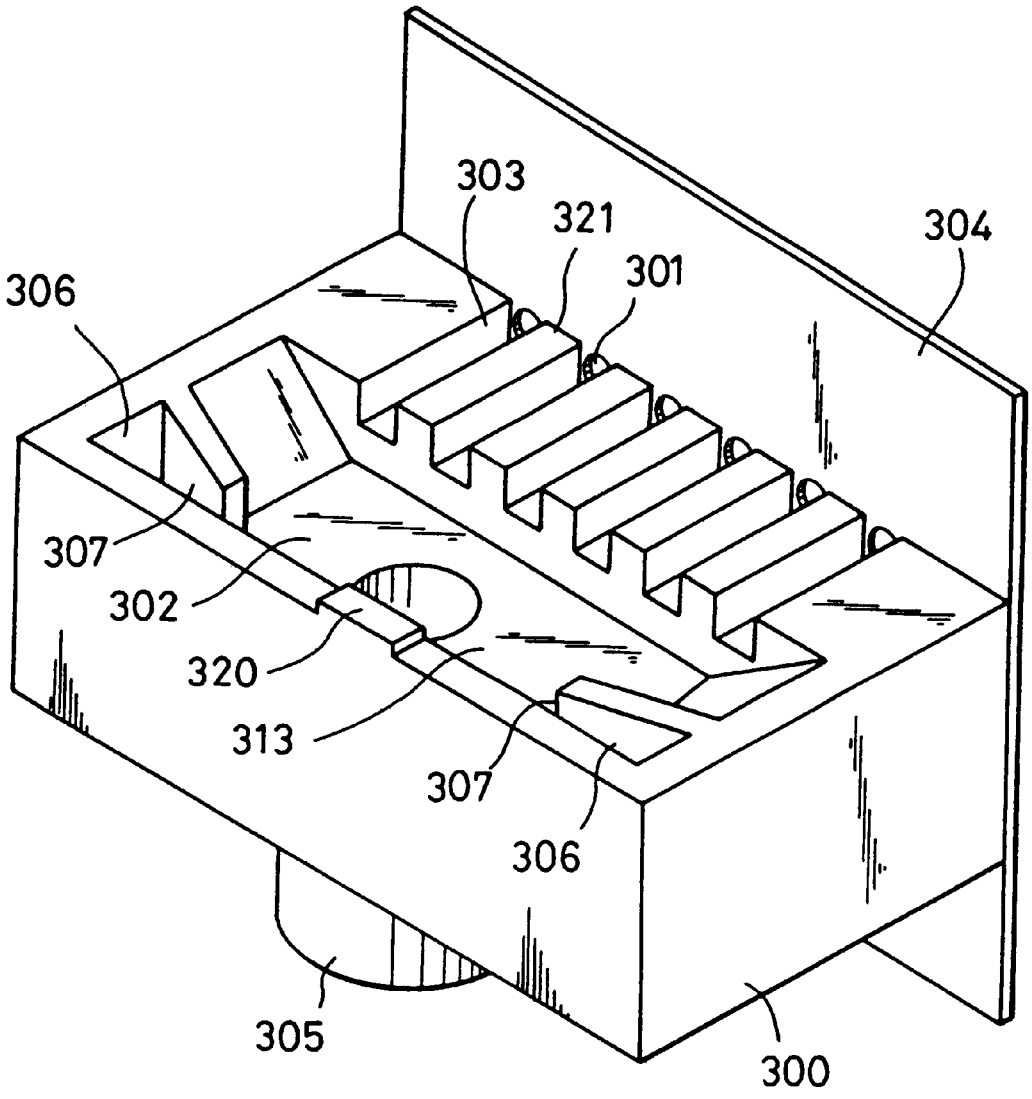
FIG. 6 illustrates the grooved member as viewed from the side of a common liquid chamber.

FIG. 6 is a perspective view of a top plate 300 as viewed from the same side the common liquid chamber 300, i.e., from the internal side of the head. Numeral 200 denotes a base plate which gives support to various component parts. Numeral 100 denotes an element substrate having a plurality of electro-thermal transducers (heaters) 101 which serve as the means for generating discharging energy. This element substrate 100 will be referred to as "heater board", hereinafter. Numeral 300 denotes a top plate having grooves defining ink flow channels 303 corresponding to a plurality of ink discharge openings 301, a recess defining a common liquid chamber 302 for storing the ink to be supplied to the ink flow channels, and a cylindrical projection in which is formed an ink filling opening 305. The top plate 300 is connected to the heater board 100 such that the heaters 101 are aligned with corresponding ink discharge openings 301. More specifically, the top plate 300 is temporarily fixed to the heater board 100 by an adhesive and, in order to achieve sufficiently large adhesion, mechanical pressing force is applied to the top plate 300 from the upper side thereof by means of springs (not shown). A protrusion 320 is formed at the rear side of the common liquid chamber 302 of the top plate 300. Consequently, the contact between the heater board 100 and the top plate 300 takes place only at the protrusion 320 and the end surfaces of the ink channel walls 321 which define the plurality of ink flow channels 303. Consequently, the end surfaces of the ink channel walls 321 make close contact with the heater board 100, thereby ensuring high degree of stability of ink discharge. Then, a sealant is applied to the periphery of the top plate 300 and the heater board 100 along the slight gap formed therebetween, so as to fill this small gap to hermetically seal the internal space formed by the ink flow channels 303 and the common liquid chamber 302. In this embodiment, the width of the above-mentioned slight gap, i.e., the height difference between the protrusion 320 and the end surface of the wall defining the common liquid chamber is set to be from 5 to 20 $\mu$m. Bubble cells (buffer chambers) 306 are formed in the portion of the top plate 300 defining the common liquid chamber 302 so as to absorb any pulsation of the pressure during discharging of the ink so as to achieve stable refilling of the ink. As shown in FIG. 6, the bubble cells are spaced as much as possible apart from the ink discharging openings 301. The bubble cells communicate with the common liquid chamber 302 through restricted communicating portions 307. In this embodiment, the direction perpendicular to the plane at which each bubble cell 306 opens into the common liquid chamber 302 does not cross the direction of the array of the ink flow channels 303. This arrangement prevents any bubbles which are grown from nucleus bubbles in the bubble cells 306 from directly reaching the regions near the ink flow channels 303, thereby preventing ink discharge failure which otherwise may occur due to growing of bubbles in such regions. It is thus possible to obtain, without incurring substantial rise in the production cost, an ink-jet recording head having a high degree of reliability. Namely, in this embodiment, the direction perpendicular to the plane at which the bubble cell opens into the common liquid chamber is substantially parallel with the direction of the array of the ink flow channels 303, so that the ink bubbles grow only in the direction parallel with the array of the channels 303 and, hence, cannot easily reach the regions near the ink discharge channels.

Figure 7:
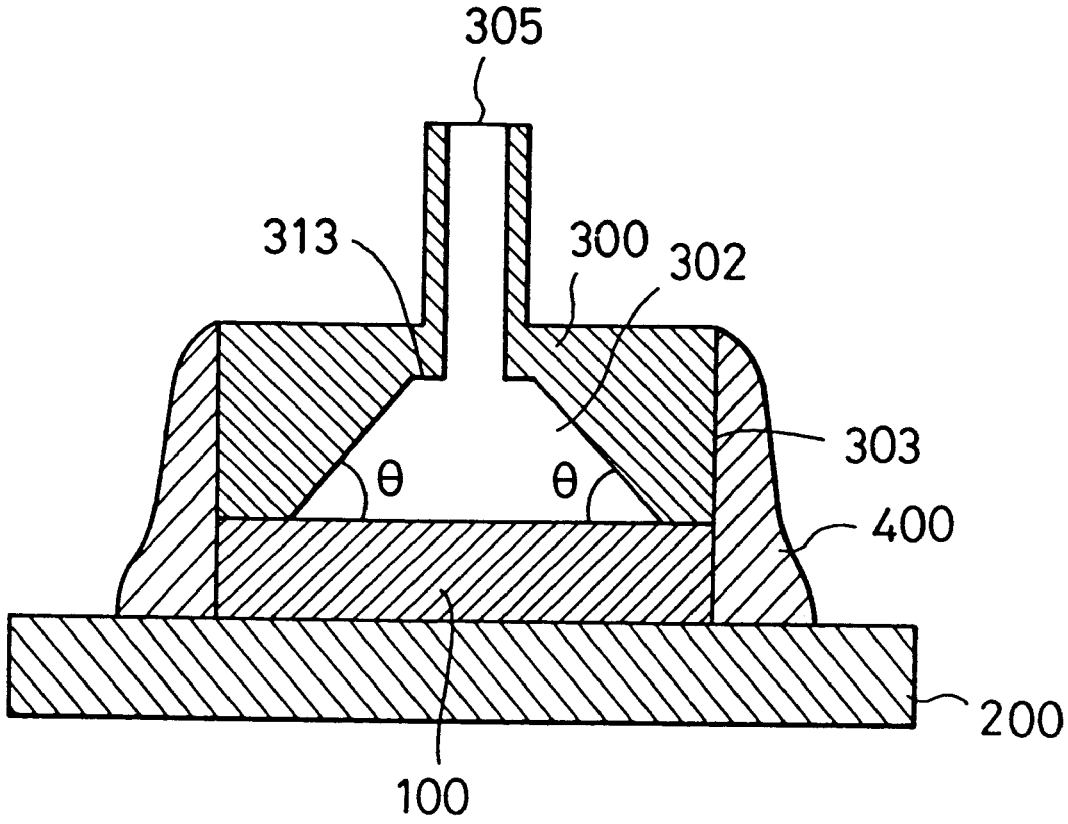
FIG. 7 is a sectional view illustrative of the head.

FIG. 7 is a schematic cross-sectional view of an embodiment incorporating a different example of the top plate 300, taken along a plane containing the axis of the ink filling opening 305 and illustrating the internal structure of the ink-jet recording head. Components other than the top plate 300 are not described since they are the same as those of the preceding embodiments.

Reduction in the size of the ink-jet recording head and, hence, of the heater board essentially reduces the size of the common liquid chamber 302 in the top plate 300. The reduction in the size of the common liquid chamber 302 poses a problem in that interruption of flow of the ink, which results in ink discharging failure, tends to be caused by bubbles stagnant in the common liquid chamber 302, even when such bubbles are so tiny as not to cause interruption of ink flow when the common liquid chamber 302 has a volume as large as that in known recording head. The inventors have found that bubbles stagnant in the common liquid chamber 302 tend to be drawn towards the ink discharge openings which are in both outer end regions of the array of the discharge openings, since the velocity of flow of the ink towards such discharge openings is higher than those towards other discharge openings, so that the ink discharge failure is liable to occur in such outer end regions of the array of the discharge openings. With this knowledge, the inventors have fabricated three different ink-jet recording heads in accordance with the present invention, employing three different angles θ formed, as shown in FIG. 7, between the heater board 100 and the side wall surfaces of the common liquid chamber which extend in parallel with the orifices. More specifically, the angle θ was set to be 35°, 40° and 45°, respectively. These three types of ink-jet recording head were subjected to a test in which the number of prints of A-4 size standard original document sustained until discharge failure due to bubble was examined. The results are shown in Table 1 below.

TABLE 1

| Angle θ | Number of prints till discharge failure | Evaluation |
|---|---|---|
| 35° | 100–150 | x |
| 40° | 200–300 | Δ |
| 45° | 450–600 | ○ |

Conventional ink-jet recording heads, when subjected to the same test, showed that they can produce 250 to 300 prints before the ink discharge fails due to bubble. It was confirmed that the ink-jet recording heads in accordance with the present invention can produce, before discharge failure due to bubble takes place, the same or a greater number of prints than the conventional ink-jet recording head, when the above-mentioned angle θ is set to be 40° or greater and the level of the top wall surface of the common liquid chamber is set to be sufficiently higher than the ink discharge openings so as to reduce the velocity of flow of ink towards both ends of the ink discharge opening array, i.e., so as to reduce the tendency for the bubbles to reach the ink flow channels in both end regions of the array of the ink discharge openings. Thus, according to the present invention, it is possible to obtain, without incurring a rise in the production cost, an ink-jet recording head which is reduced in size and which can operate with a high degree of reliability.

Figure 8:
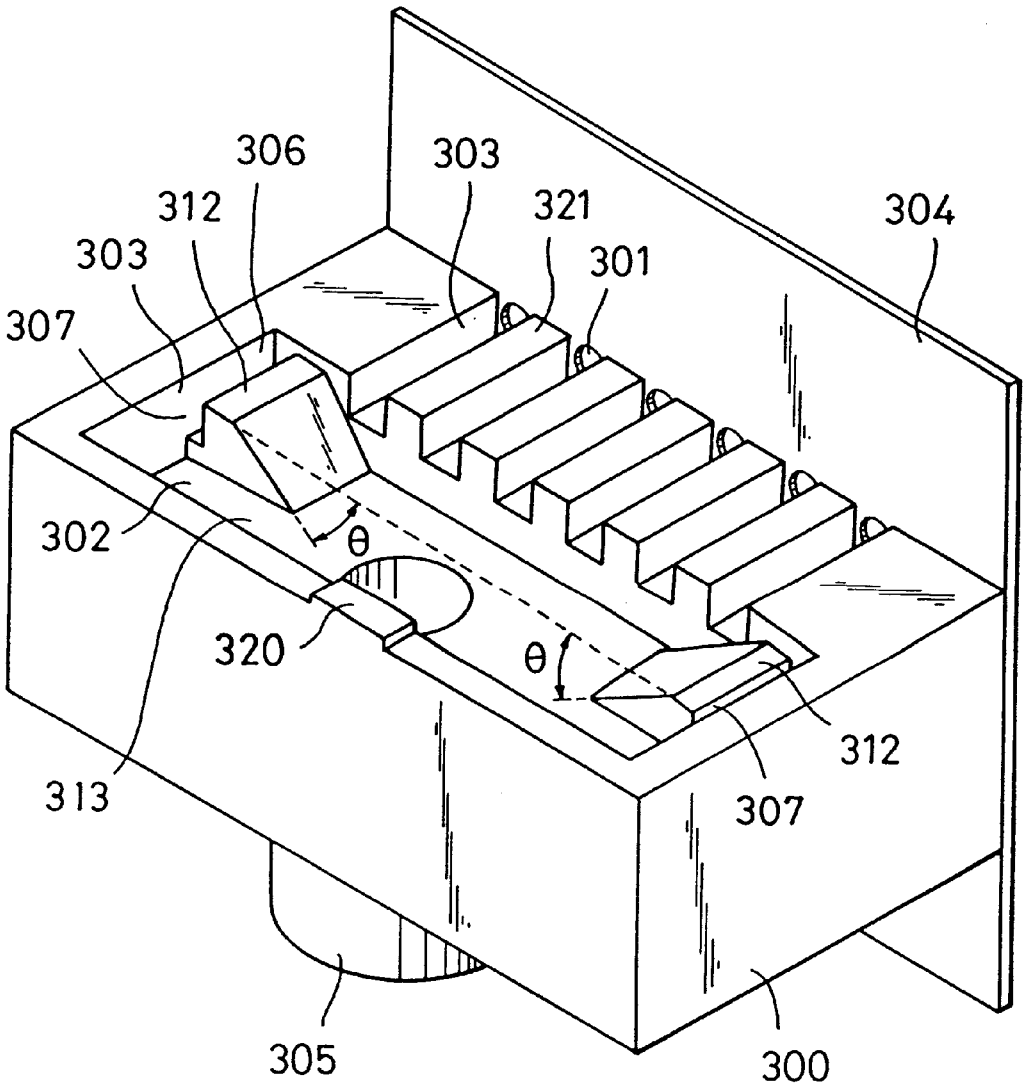
FIG. 8 illustrates the grooved member, as viewed from the side of the common liquid chamber.

FIG. 8 shows a different top plate 300 incorporated in an embodiment of the ink-jet recording head of the present invention, as viewed from the same side as the common liquid chamber 302.

In this top plate 300, the bubble cells 306 are arranged in the vicinity of a plurality of ink discharge openings 301, as illustrated in FIG. 8. A reduction in the size of the heater board 100 causes a reduction in the distance between the end of the heater board and the outermost ink discharge openings, so that the bubble cells 306 also have to be located closer to the ink flow channels 303. In this embodiment, the bubble cell is so constructed that the direction of the communicating portion 307 of the bubble cell, i.e., the direction perpendicular to the plane at which the bubble cell 306 opens into the common liquid chamber 302, does not cross the direction of array of the ink flow channels. Moreover, in this embodiment, the above-mentioned communicating portion 307 opens in the side of the bubble cell opposite to the array of the ink flow channels. Therefore, growth of bubbles in the bubble cell, if any, occurs only in the direction away from the array of the ink flow channels, thus suppressing tendency for such grown bubbles to reach the ink flow channels.

The bubble cells which are formed along the walls of the common liquid chamber 302 also serves as a space which accommodates any surplus portion of the sealant which is used for sealing the common liquid chamber 302 from the exterior, so as to prevent such surplus portion of the sealant from flowing into the ink flow channels, thus providing an ink-jet recording head of a high degree of reliability.

In the embodiment shown in FIG. 8, the direction in which the communicating portion 307 of the bubble cell 306 opens into the common liquid chamber 302 does not intersect the array of the ink flow channels. At the same time, the partition wall 312 separating the bubble cell 306 from the common liquid chamber 302 has a surface which faces the common liquid chamber 302 and which is inclined to the heater board at an angle which is not smaller than 40°. As shown in FIG. 8, when the bubble cells 306 are arranged in the vicinity of the ink discharge openings 301, the height of the partition wall 312 is so determined that, when the top plate 300 is placed in contact with the heater board 100, a slight gap is formed between the heater board 100 and the opposing surface of the partition wall 312. In this embodiment, the size of this slight gap is set to be from 0.05 mm to 0.1 mm. This slight gap is intended to achieve, as stated before, sufficient tightness of contact between the heater board 100 and the ink flow channel walls 309. This arrangement poses a risk in that bubbles grown in the bubble cell 306 are relieved into the common liquid chamber 302 not only through the aforesaid communicating portion 307 but also through the above-mentioned slight gap between the surface of the partition wall 312 and the heater board. Since the bubble cells are located near the ink flow channels, these bubbles tend to reach the ink flow channels 303 so as to cause ink discharge failure. In order to obviate this problem, in the ink-jet recording head of the present invention, it is necessary to set the angle between the heater board and the surface of the partition wall 312 defining the side wall surface of the common liquid chamber 302 to a value not smaller than 40°, while determining the level of the top surface of the common liquid chamber to be sufficiently higher than the level of the ink flow channels 303. Such structural features effectively reduce the tendency for the bubbles relieved through the above-mentioned slight gap to reach the ink flow channels 303, thus preventing occurrence of ink discharge failure. It is thus possible to obtain, without raising the cost of production, a highly reliable ink-jet recording head having a reduced size.

A description will now be given of a different example of the buffer chamber.

The inventors have found that buffering effect varies according to the positions of the buffer chambers, and confirmed that the best results are obtained when the buffer chambers are disposed behind the nozzles. Buffer chambers disposed at such positions enable high-speed driving even in time-divided driving mode, regardless of the size of the exothermic resistors and the size of the common liquid chamber.

In this embodiment of the invention, when a voltage pulse is applied to the exothermic resistor, the temperature of the heat-acting portion is raised so as to evaporate the portion of the ink which is in the vicinity of such a heat-acting portion. Simultaneously with the evaporation of the ink, air which has been dissolved in the ink also is precipitated, and the precipitated air is discharged from the orifice together with the jet of the ink droplet. Thus, there is no risk that the precipitated air stagnates in the nozzle to hamper the discharge of the ink. In this embodiment, the precipitated air is intentionally caused to stably reside in the ink-jet recording head.

Figure 9B:
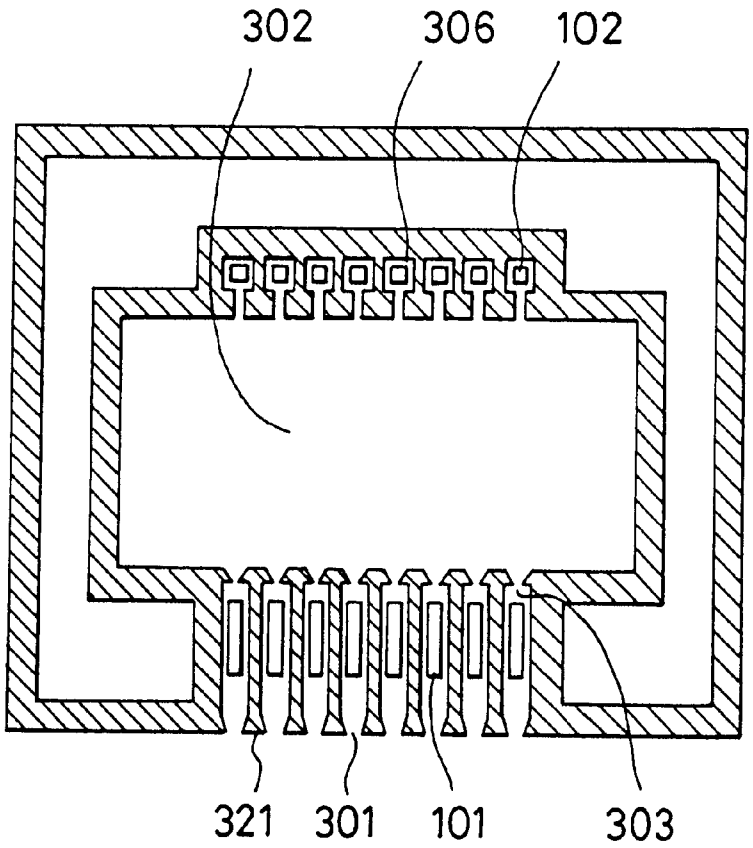
FIGS. 9(*a*) and 9(*b*) are schematic sectional views illustrative of the head of the present invention.
Figure 9A:
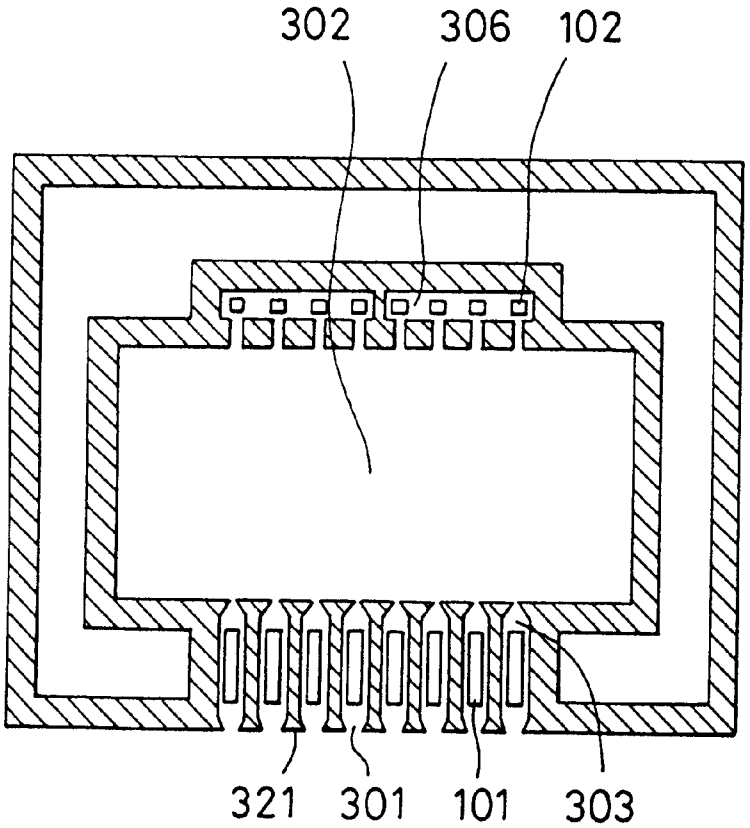

FIGS. 9(*a*) and 9(*b*) are sectional views of this embodiment of the ink-jet head. Buffer chambers 306 are formed so as to oppose the ink flow channels 303. Each buffer chamber 306 is provided with bubble forming means 102 as in preceding embodiments. The communication passages which provide communication between the buffer chambers and the common liquid chamber are aligned with the ink flow channels. Thus, the number of the buffer chambers is equal to the number of the ink flow channels. With this arrangement, it is possible to efficiently absorb the back pressure waves generated when the ink droplet is discharged.

FIG. 9(*a*) illustrates an ink-jet recording head in which there are two comparatively large buffer chambers each having plural communication passages, while FIG. 9(*b*) shows an arrangement in which a plurality of discrete buffer chambers, each having a communication passage, are formed.

Figure 10:
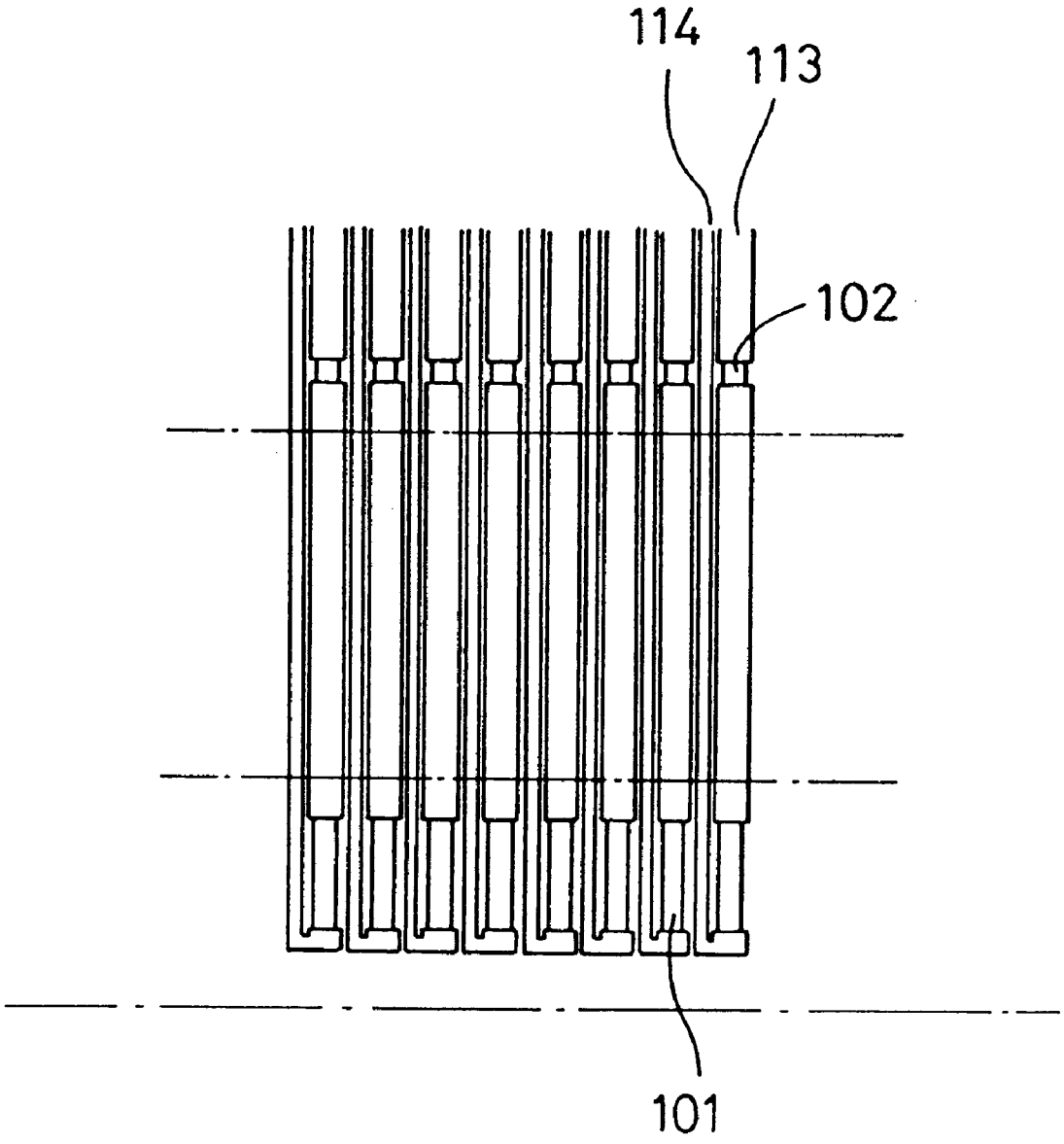
FIG. 10 illustrates a circuit pattern on a heater board.
Figure 11:
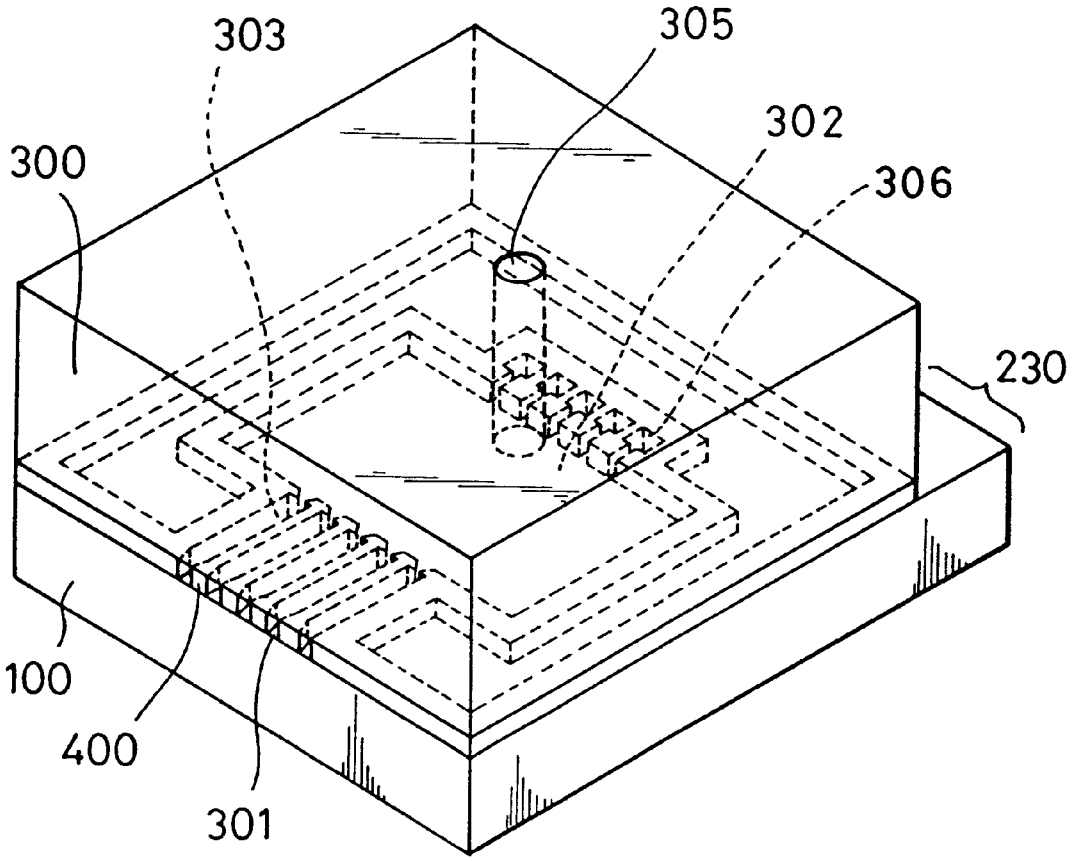
FIG. 11 is a perspective view illustrative of the head of the present invention.

FIG. 10 illustrates configurations of exothermic portions and electrodes on the heater board 100 used in this embodiment. An exothermic portion of an electro-thermal transducer as an element for generating the ink jetting energy and an exothermic portion 102 provided in the buffer chamber are connected in series between each of individual wiring 114 and a common wiring 113 (plural wirings 113 are shown but they merge into a common line at a position which is not shown in FIG. 10). These two exothermic portions simultaneously exhibit temperature rise when a voltage pulse is applied between the individual wiring 114 and the common wiring 113. When the buffer chamber is filled with gases as shown in FIGS. 9(*a*) and 9(*b*), no bubble is generated by the exothermic portion which is inside the buffer chamber. However, when the gases in the buffer chamber has been replaced with the ink as a result of a discharge recovery operation which is usually conducted for the purpose of preventing clogging of orifices by applying vacuum suction from the outlet side of the orifices to suck stagnant viscous ink, i.e., when ink exists in contact with the exothermic portion in the buffer chamber, this exothermic portion serves to generate a bubble while causing the dissolved air to be precipitated. The exothermic portion in the nozzle can stably generate bubble since the gases constituting the bubbles, together with ink droplet, can be discharged to the exterior of the nozzle without encountering substantial resistance. In contrast, the exothermic portion inside the buffer chamber cannot stably generate bubbles, due to large resistance encountered when the liquid ink is displaced from the buffer chamber to the common liquid chamber as a result of generation of the bubbles. Consequently, the air precipitated in the buffer chamber remains to stagnate about the exothermic resistor in the buffer chamber, thus serving as a buffer which absorbs any pressure variation produced in the heat-acting portion. This embodiment of the invention, therefore, can stably produce air plenum or buffer which effectively absorbs pressure variation.

Ink jet heads as shown in FIGS. 1 and 2 were fabricated as follows.

An Si wafer was thermally oxidized to form an $SiO_2$ film of 3 $\mu$m thick, whereby a substrate was obtained. $HfB_2$ film of 1500 Å, intended to serve as an exothermic resistor, was formed on the substrate by sputtering, followed by successive deposition of 50-Å Ti film and 6000-Å Al film by electron beam evaporation deposition.

Then, a patterning photolithographic process was executed so as to form exothermic resistors as the heat-acting portions at a pitch of 360 DPI and to form also exothermic resistors at portions which are to form buffer chambers. The exothermic resistor formed under the heat-acting portion had a rectangular shape of 28 $\mu$m wide and 110 $\mu$m long. 512 such exothermic resistors were arrayed. Similarly, 512 pieces of the exothermic resistors, each being 28 $\mu$m wide and 28 $\mu$m long, were arrayed side by side. These exothermic resistors were connected in a wiring pattern as shown in FIG. 10. The exothermic resistor of each heat-acting portion and the exothermic resistor corresponding thereto were connected in series to each other so as to simultaneously generate heat in response to the same electric pulse. Then, an $SiO_2$ film, a $Ta_2O_5$ film and a Ta film were successively deposited by sputtering to thicknesses of 1.5 $\mu$m, 500 Å and 5000 Å, respectively, followed by patterning through a photolithographic process and a dry etching process, whereby a protective film was formed.

Subsequently, a dry film of negative type, made of a photosensitive resin and having a thickness of 25 $\mu$m, was laminated, and a photolithographic process was executed so as to form nozzles, part of the common liquid chamber and buffer chambers which provide gas-liquid interface. The buffer chambers were formed at portions of the common liquid chamber corresponding to the nozzles in alignment therewith as shown in FIG. 9(*b*). The size of the communicating portion at which each buffer chamber opens to the common liquid chamber was set to 20 $\mu$m.

Then, a dry film (photosensitive resin) of negative type was laminated on a glass having an engraved portion (50 mm long and 4 mm wide) constituting part of the common liquid chamber and having also a through hole providing the ink filling port. The laminated structure was subjected to a patterning photolithographic process and, thereafter, was bonded to the above-mentioned substrate.

Then, a driver IC die-bonded on a printed circuit board was electrically connected by wire bonding to the substrate, thus completing an ink-jet head.

Figure 12A:
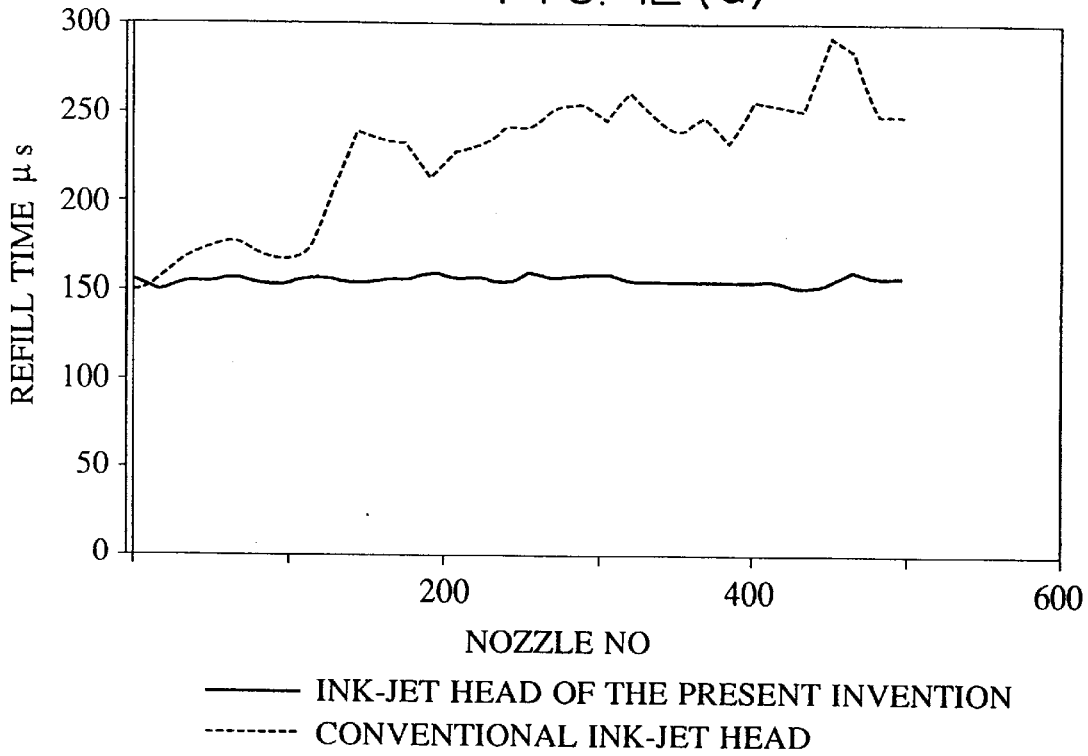
FIGS. 12(*a*) and 12(*b*) are diagrams showing refilling capabilities of the head of the present invention.
Figure 12B:
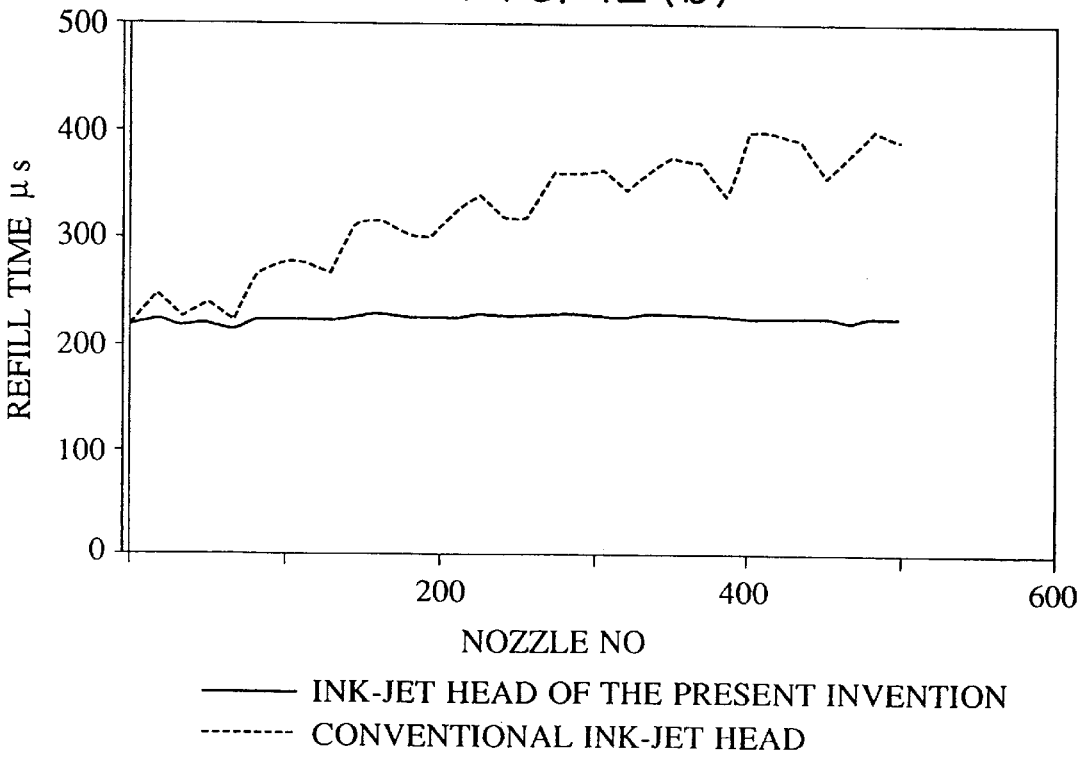

The nozzles of the ink-jet head thus produced was divided into 8 blocks, each including adjacent 64 nozzles, and these 8 blocks of nozzles were driven. FIG. 12(*a*) shows the meniscus restoration time as observed in the ink-jet head of the present invention in comparison with that in an ink-jet head which is devoid of the buffer chamber. As will be seen from this Figure, the ink-jet head of the present invention could be driven at high speed and exhibited good state of printing even at high discharging frequency of 6 kHz.

A description will now be given of another example of the production process.

An Si wafer was thermally oxidized to form an $SiO_2$ film of 3 $\mu$m thick, whereby a substrate was obtained. $HfB_2$ film of 1500 Å, intended to serve as an exothermic resistor, was formed on the substrate by sputtering, followed by successive deposition of 50-Å Ti film and 6000-Å Al film by electron beam evaporation deposition.

Then, a patterning photolithographic process was executed so as to form exothermic resistors as the heat-acting portions at a pitch of 200 DPI and to form also exothermic resistors at portions which are to form buffer chambers. The exothermic resistor formed as the heat-acting portion had a rectangular shape of 34 $\mu$m wide and 150 $\mu$m long. 512 such exothermic resistors were arrayed. Similarly, 512 pieces of the exothermic resistors, each being 30 $\mu$m wide and 30 $\mu$m long, were arrayed side by side. Then, an $SiO_2$ film, a $Ta_2O_5$ film and a Ta film were successively deposited by sputtering to thicknesses of 1.0 $\mu$m, 500 Å and 3500 Å, respectively, followed by patterning through a photolithographic process and a dry etching process, whereby a protective film was formed.

Subsequently, a dry film of negative type, made of a photosensitive resin and having a thickness of 50 μm, was laminated, and a photolithographic process was executed so as to form nozzles, part of the common liquid chamber and buffer chambers which provide gas-liquid interface. The buffer chambers were formed at portions of the common liquid chamber corresponding to the nozzles in alignment therewith, so as to open to the common liquid chamber through an opening of 20 μm wide, the buffer chambers being grouped such that each block includes four nozzles.

Then, a dry film (photosensitive resin) of negative type was laminated on a glass having an engraved portion (80 mm long and 4 mm wide) constituting part of the common liquid chamber and having also a through hole providing the ink filling port. The laminated structure was subjected to a patterning photolithographic process and, thereafter, was bonded to the above-mentioned substrate.

Then, a driver IC die-bonded on a printed circuit board was electrically connected by wire bonding to the substrate, thus completing an ink-jet head.

The nozzles of the ink-jet head thus produced was divided into 16 blocks, each including adjacent 32 nozzles, and these 8 blocks of nozzles were driven. FIG. 12(*b*) shows the meniscus restoration time as observed in the ink-jet head of the present invention in comparison with that in an ink-jet head which is devoid of the buffer chamber. As will be seen from this Figure, the ink-jet head of the present invention could be driven at high speed and exhibited good state of printing even at high discharging frequency of 4 kHz.

FIGS. 12(*a*) to 15 are illustrations of relationships among the components such as a print head unit IJU, ink tank IT, print head cartridge IJC and the ink-jet printer main part IJRA, suitable for carrying out the present invention. A description will now be given of each of such components with reference to these Figures.

Figure 13:
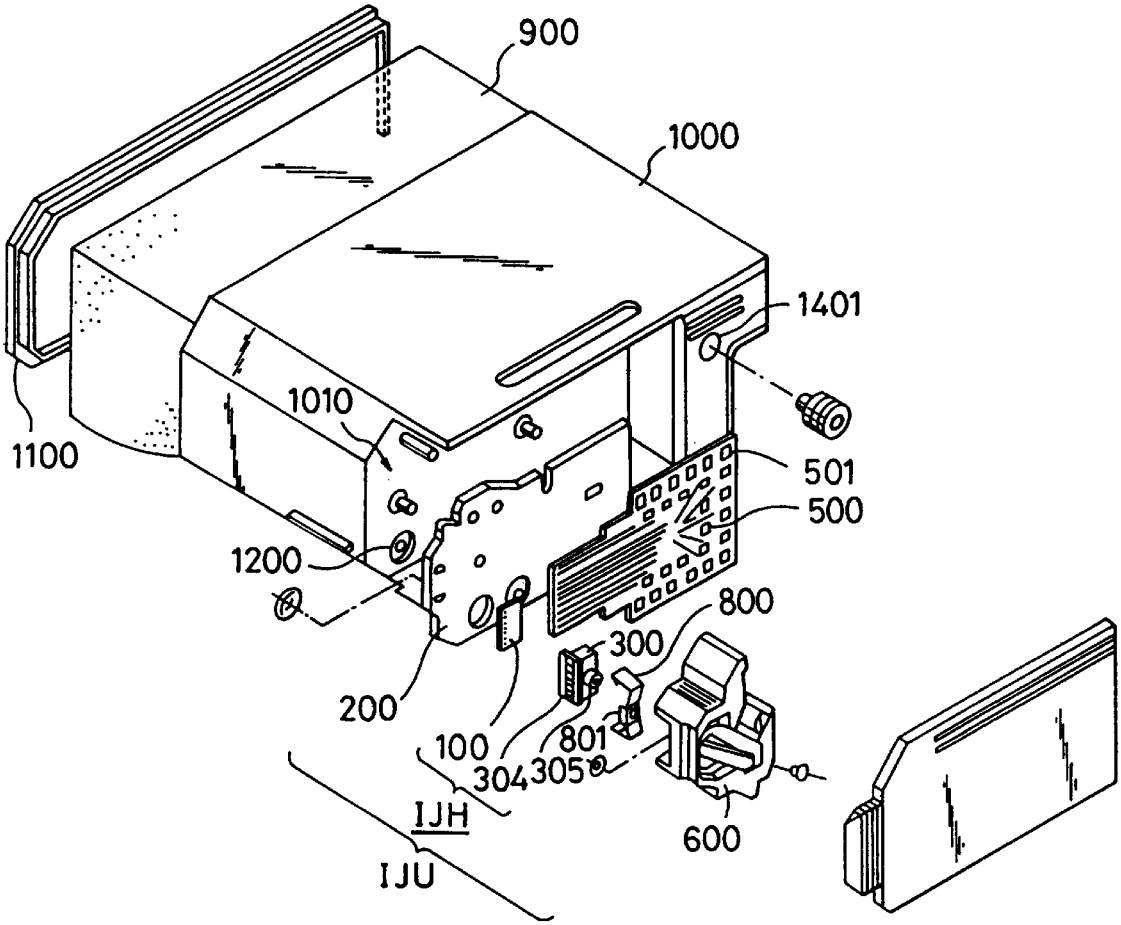
FIG. 13 is an exploded view illustrative of a head cartridge of the present invention.

FIG. 13 is an exploded perspective view of an example of the head cartridge.

Referring to this Figure, a print head unit IJU is a bubble-jet type unit which performs discharging of discrete ink droplets as a result of film boiling of ink caused by thermal energy generated in accordance with an electric signal. A heater board 100 as a device substrate is constituted by an Si substrate, a plurality of electro-thermal transducers (discharge heaters) as the discharge energy generating elements for generating the above-mentioned thermal energy, and electric wirings such as of Al for supplying electric power to these transducers, the transducers and the electric wirings being formed on the Si substrate by film-forming techniques. A wiring board 500 has wirings corresponding to the wirings on the heater board 100. The wirings on the wiring board 500 are connected to the wirings on the heater board 100 by, for example, wire bonding. The wiring board 500 also has pads 501 provided on the ends of the wirings so as to receive electric signals from the main part of the apparatus. A top plate 300 which is a grooved member has a plurality of grooves for forming ink flow channels corresponding to the ink discharge openings, and a well or a recess which partly defines a common liquid chamber. The top plate 300 further has an ink filling opening 305 for receiving ink from an ink tank as an ink container so as to deliver the ink to the common liquid chamber, and is integrally provided with an orifice plate 304 which has the above-mentioned plurality of discharge openings. The grooves and the recess are formed integrally with the top plate 300, preferably by molding from polysulfone, although other moldable resin can be used as the material.

A support 200 supports the back side of the wiring board 500 and is made of, for example, a metal. The support 200 serves as a structural member of the print head unit. A pressing spring 800 has an M-shaped cross-section the midst portion of which presses the portion of the top plate 300 corresponding to the common liquid chamber. A front free end portion 801 of the pressing spring 500 makes a line contact with the portion of the top plate 300 corresponding to the ink flow channels so as to press the top plate 300 at this portion. The heater board 100 and the top plate 300 are pressed and fixed to the support 200 by the urging force exerted by the mid portion n and the front free end portion 801 of the spring 800. The electric signals from the main part of the recording apparatus are delivered to the heater board 100 through the wiring board. The fixing of the wiring board 500 to the support 200 is achieved by bonding with, for example, an adhesive.

An ink supply passage member 600 is intended to supply the ink from the ink tank to the head unit.

The ink tank has a cartridge main part 1000, an ink absorber 900, and a cover 1100 for sealing the ink absorber 900 after the ink absorber 900 is inserted into the cartridge main part 1000 from the side opposite to the ink-jet unit IJU. A supply port 1200 is used for supplying the ink to the ink-jet unit IJU. The supply port 1200 also provides with a passage for the ink for impregnating the absorber 900. Namely, ink is charged through this port 1200 before the ink jet unit is mounted on a portion 1010 of the cartridge body 1000 so as to impregnate the ink absorber 900 with the ink. Thus, the ink tank can be charged with the ink either through the atmospheric vent hole 1401 or the supply port 1200.

Figure 14:
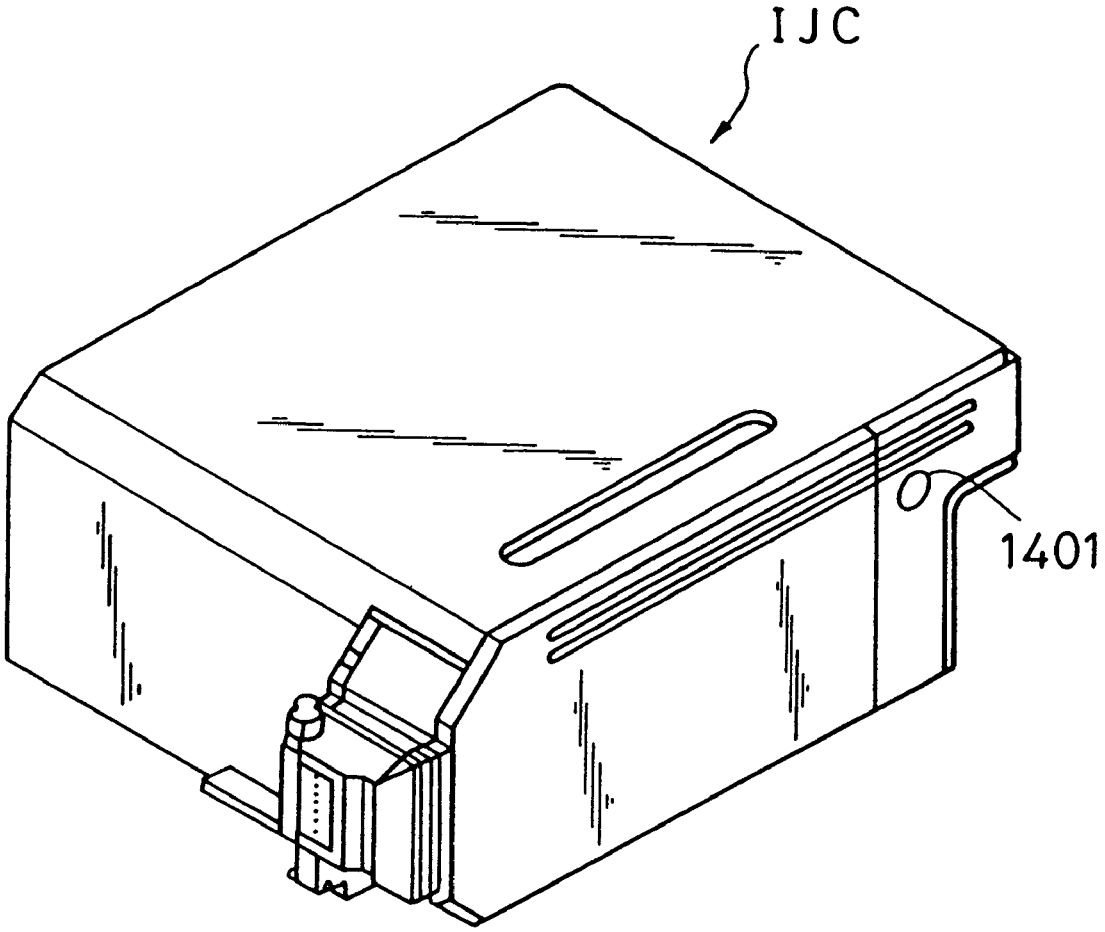
FIG. 14 is a perspective view illustrative of the head cartridge of the present invention.

In the head cartridge IJC as assembled in a manner shown in FIG. 14, the ink is introduced from the ink supply port 1200 of the ink tank into a conduit in the ink supply member 600 and, after flowing through the conduit, introduced into the common liquid chamber through the ink filling opening 305 in the top plate 300. Packings made of silicone rubber or butyl rubber are incorporated in the joint portions of the supply tubes and conduits so as to seal and preserve the passage of the ink.

In the illustrated embodiment, the top plate 300 is molded integrally with the orifice plate 400 by a die, from a resin which excels-in anti-ink characteristics such as polysulfone, polyether sulfone, polyphenylene oxide and polypropylene.

Thus, the ink supply member 600, the unit composed of the top plate and the orifice plate, and the ink tank main part 1000, respectively, are formed as independent integral parts, so that the assembly precision is enhanced and the product quality can effectively be improved in mass-production. In addition, the reduced number of parts as compared with known units offers an advantage in that desired characteristics can be attained without fail.

Figure 15:
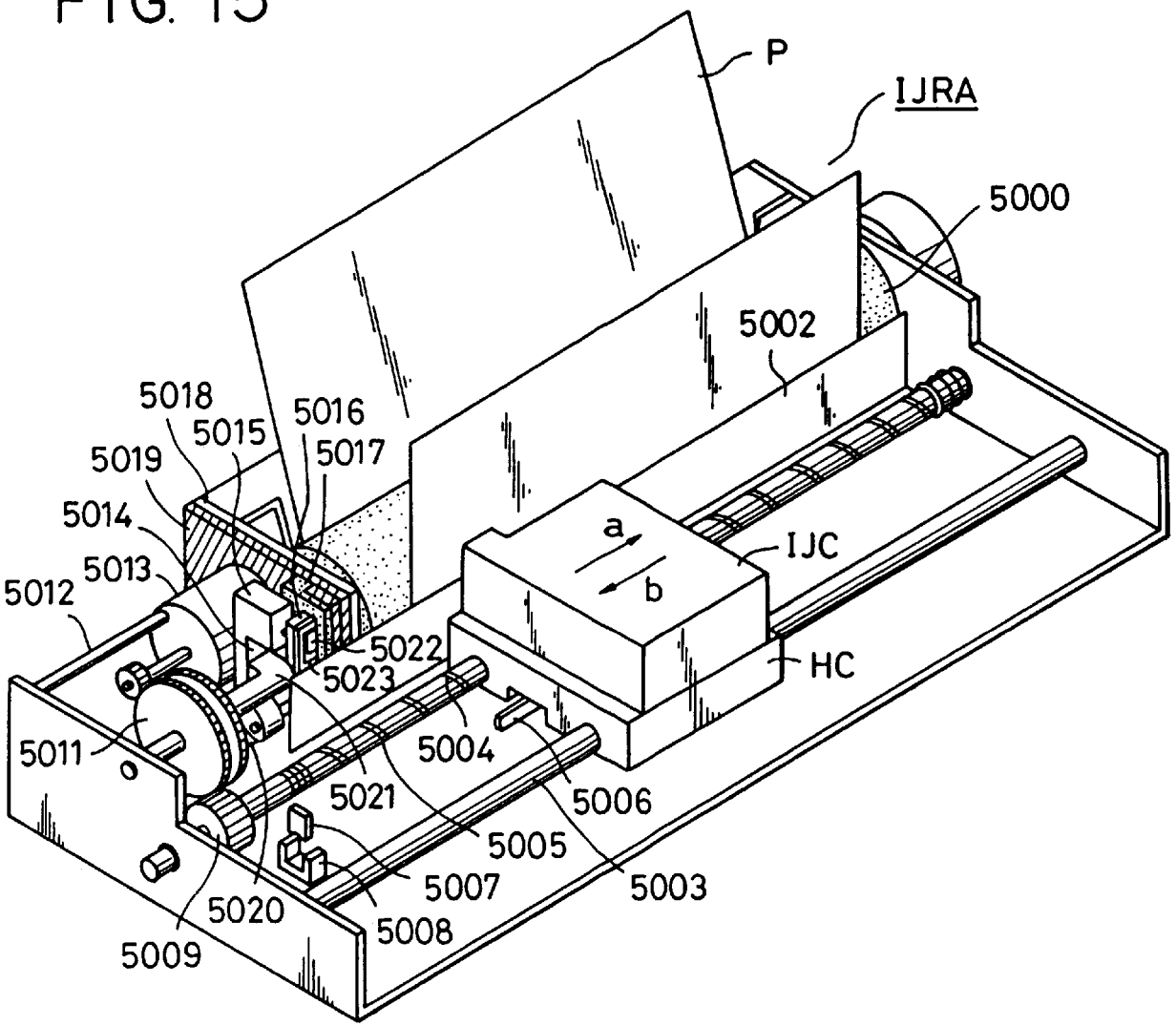
FIG. 15 illustrates an ink-jet printer upon the application of the head of the present invention.

FIG. 15 is a schematic perspective view of an ink-jet printing apparatus IJRA to which the present invention is applied. Forward/backward rotation of the shaft of a drive motor 5013 is transmitted to a lead screw 5013 through transmission gears 5011 and 5009. Resultant rotation of the lead screw 5005 causes a carriage HC to reciprocately move in the directions of arrows "a" and "b" through engagement between a pin (not shown) of the carriage HC and a groove 5004. Numeral 5002 denotes a sheet pressing plate which serves to press a print paper sheet as a recording medium onto a platen 5000 serving as a recording medium transporting means, over the entire length of stroke of the carriage. Numerals 5007 and 5008 denote photo-couplers. The arrangement is such that, the photo-couplers 5007, 5008 cooperate with a lever 5006 on the carriage HC so as to detect that the carriage HC is at the position where these photo-couplers are located, thus generating signals for controls such as reversing of the motor 5013. Numeral 5016 denotes a member for supporting a cap 5022 for capping the front face of the print head. Numeral 5015 denotes suction means including, for example, a suction pump for sucking air from the interior of the cap. The suction means is intended to suck ink and gasses from the interior of the print head, through an opening 5023 formed in the cap, thereby effecting recovery of the discharging condition of the print head. Numeral 5017 designates a cleaning blade which is adjustable in back and forth directions by means of a member 5019 which is supported by a main part support plate 5018. The illustrated form of the blade is not exclusive and any known cleaning blade can obviously be used equally well. Numeral 5012 denotes a lever for initiating the sucking operation for recovering the discharge condition. This lever 5021 is moved in accordance with the movement of the cam 5020 which engages with the carriage HC in accordance with the movement of the carriage HC. This movement is performed by the power from the drive motor transmitted through a known transmission means such as that including a clutch.

The arrangement may be such that the described operations, i.e., capping, cleaning and sucking recovery operation, are respectively conducted at respective rotational position of the groove 5004 in the lead screw 5005 when the carriage HC has been brought to the home position, although these operations may be performed at suitable timings under different controls.

The apparatus in accordance with the present invention has activating means for activating the bubble forming means, as well as control means for controlling the recovery operation and the bubble forming operation.

Figure 16:
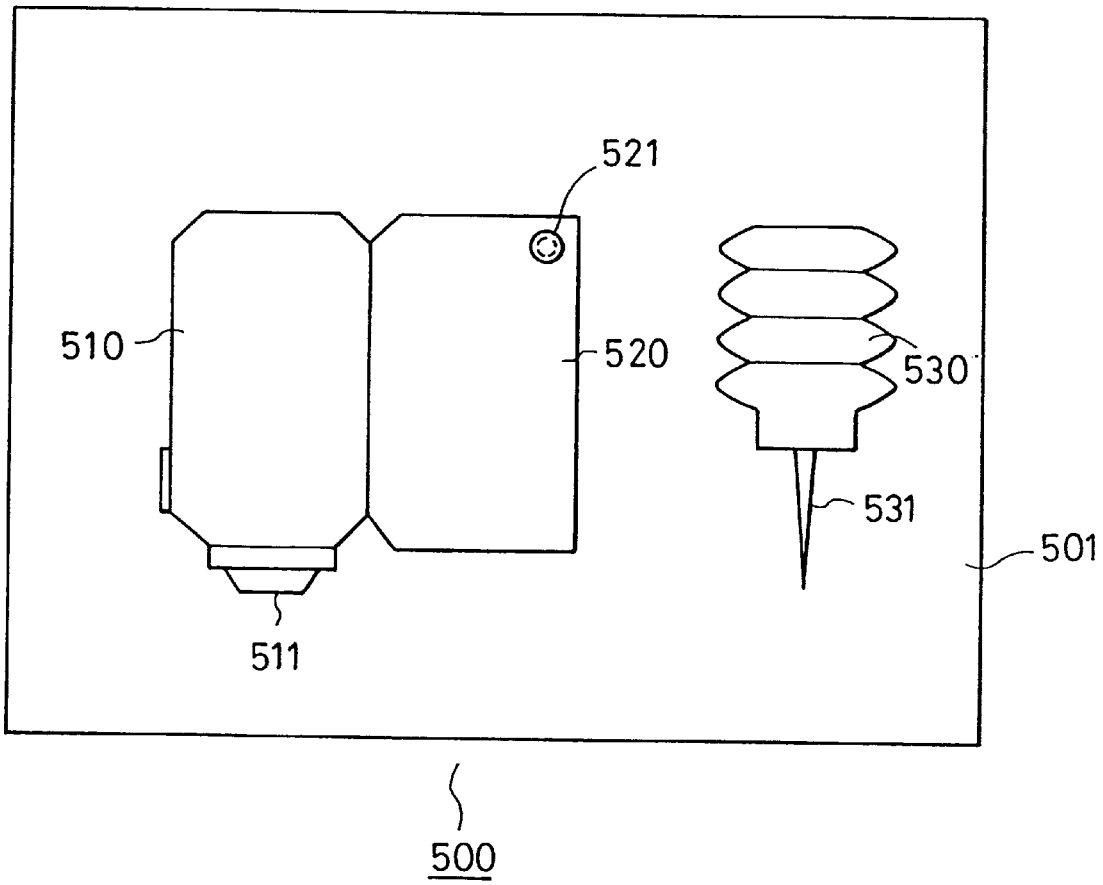
FIG. 16 illustrates an ink-jet kit upon the application of the head of the present invention.

A description will now be given of a refill kit, i.e., an ink-jet head kit having the ink-jet head of the present invention. FIG. 16 is a schematic illustration of an ink-jet head kit 500 having an ink-jet head constructed in accordance with the present invention. The ink-jet head kit includes the ink-jet head 510 of the invention having an ink discharging section 511, an ink container separable or inseparable from the ink-jet head 510, an ink refilling means which holds ink for refilling the ink container, and a kit container which contains the ink-jet head 510, ink container 520 and the ink refilling means 530.

When the ink has been consumed away, a portion of an insertable part, e.g., an injector needle, 531 of the ink refilling means 530 is inserted into, for example, an atmospheric vent hole 521 of the ink container, a junction between the ink container and the ink-jet head, or an aperture formed in a wall of the ink container, so as to refill the ink container with the ink from the ink refilling means.

The described kit-type construction in which the ink-jet head of the invention is contained in a kit container together with the ink container and the ink refilling means permits an easy refilling of the ink container when ink in the ink container has been consumed, thus permitting quick start of the recording.

Although the illustrated ink jet head kit includes the ink refilling means, it is to be understood that the ink-jet head kit may include only the ink-jet head and an ink container separable from the ink-jet head and filled with the ink encased in the kit container 500.

As will be understood from the foregoing description, according to the present invention, it is possible to form and hold bubbles which do not adversely affect jetting of the ink, by virtue of the provision of buffer chambers communicating with the common liquid chamber and provided therein with bubble generating means. These bubbles effectively function as a buffer which is deformable to absorb any bubbling energy (pressure wave) transmitted to the ink inside the common liquid chamber when a bubble for jetting ink droplet is formed. Namely, refilling after discharge of an ink droplet can be performed without delay.

In addition, when the bubbles in the buffer chambers are sucked and extinguished as a result of discharge of the ink from the ink passage system due to a recovery operation, optimum volumes of bubbles can be obtained without delay by conducting the bubble forming operation without delay after the recovery operation.

Furthermore, according to the invention, bubbles are formed by heating the ink in the buffer chamber in advance of the recording operation. Such bubbles effectively contribute to smooth printing.

In the present invention, it is important that bubbles exist in the buffer chambers at the beginning of the printing operation.

The ink-jet head in accordance with the present invention is so constructed that bubbles can hardly be relieved from the buffer chamber, so that good buffering effect can be obtained. Even when the bubbles are drawn from the bubble chambers as a result of sucking recovery operation, the bubble chambers can easily be refilled with bubbles which are easily formed by the bubble generating means without delay after the recovery operation. It is therefore possible to design the common liquid chamber such that the bubble in the common liquid chamber can easily be removed without paying specific attention to preservation of bubbles in the buffer chambers.

In a specific form of the present invention, the direction perpendicular to the plane at which each buffer chamber opens in the common liquid chamber does not intersect the direction of array of the ink discharge openings. Such an arrangement makes it difficult for the bubbles grown on the nucleus bubbles in the buffer chamber to reach the ink flow channels leading to discharge openings, thus preventing occurrence of ink discharge failure which otherwise may be caused by introduction of bubbles into the ink flow channels. It is thus possible to obtain a highly reliable ink-jet recording head having a reduce size at a low cost of production.

In another specific form of the present invention, an ink-jet recording head has buffer chambers which are arranged behind the nozzles in alignment with the such nozzles, and exothermic resistors are provided in these buffer chambers so as to stably maintain bubbles in these buffer chambers. It is thus possible to obtain an ink-jet head which can be driven at high speed and which has a reduced size of substrate, at a low cost of production.

What is claimed is:

1. An ink-jet head for performing recording by discharging an ink, comprising:

an element substrate having discharge energy generating elements for discharging said ink, and disposed in ink flow channels, said element substrate further having bubble generating means for generating bubbles to be preserved in bubble chambers, the bubble generating means generating bubbles using heat; and a grooved member integrally having discharge openings through which said ink is discharged, grooves constituting said ink flow channels, a recess partly defining a common liquid chamber for commonly supplying said ink flow channels with said ink, and a recess defining a buffer chamber for preserving bubbles and communicating only and directly with said common liquid chamber, said buffer chamber communicating with the ink flow channels through the common liquid chamber, said ink-jet head being formed by joining said element substrate and said grooved member to each other, wherein a direction perpendicular to a plane at which said buffer chamber opens in said common liquid chamber does not cross a direction of array of communication ports through which said ink flow channels communicate with said common liquid chamber.

2. An ink-jet head according to claim 1, wherein a direction perpendicular to a plane at which said buffer chamber opens in said common liquid chamber is parallel to a direction of array of communication ports through which said ink flow channels communicate with said common liquid chamber.

3. An ink-jet head according to claim 1, wherein said buffer chamber communicates with an end of said common liquid chamber opposite to said ink flow channels.

4. An ink-jet head according to claim 1, further comprising an other buffer chamber, and wherein said buffer chamber and said other buffer chamber are not communicated with each other.

5. An ink-jet head according to claim 1, wherein said energy acting portion has an electro-thermal transducer for generating thermal energy which causes film boiling of said ink.

6. An ink-jet head according to claim 1 or 2, wherein said bubble generating means provided in said buffer chamber includes thermal energy generating means for generating thermal energy which causes nucleate boiling of said ink.

7. An ink-jet head according to claim 6, wherein said bubble generating means includes an electro-thermal transducer.

8. An ink-jet head according to claim 1, wherein said buffer chamber communicates with said common liquid chamber through a restricted passage.

9. An ink-jet head according to claim 1, wherein a plurality of buffer chambers are provided for a single common liquid chamber.

10. An ink-jet head for performing recording by discharging an ink, comprising:

an element substrate having discharge energy generating elements for discharging said ink, and disposed in ink flow channels, said element substrate further having bubble generating means for generating bubbles to be preserved in bubble chambers, the bubble generating means generating bubbles using heat; and a grooved member integrally having discharge openings through which said ink is discharged, grooves constituting said ink flow channels, a recess partly defining a common liquid chamber for commonly supplying said ink flow channels with said ink, and a recess defining a buffer chamber for preserving bubbles and communicating only and directly with said common liquid chamber, said buffer chamber communicating with the ink flow channels through the common liquid chamber, said ink-jet head being formed by joining said element substrate and said grooved member to each other, wherein the common liquid chamber has a side surface and an angle formed between said side surface of said common liquid chamber as viewed from the common liquid chamber and said substrate is greater than 40°.

11. An ink-jet head according to claim 10, wherein said discharge energy generating element has an electro-thermal transducer for generating thermal energy which causes film boiling for said ink.

12. An ink-jet head cartridge for performing recording by discharging an ink, comprising:

an ink-jet head including: an element substrate having discharge energy generating elements for discharging said ink, and disposed in ink flow channels, said element substrate further having bubble generating means for generating bubbles to be preserved in bubble chambers, the bubble generating means generating bubbles using heat, a grooved member having discharge openings through which said ink is discharged; grooves constituting ink flow channels corresponding to said discharge openings, each said ink flow channel having a discharge energy acting portion in which discharge energy for discharging the ink acts on said ink; a recess partly defining a common liquid chamber for commonly supplying said ink flow channels with said ink; and a recess defining a buffer chamber for preserving bubbles and communicating only and directly with said common liquid chamber, said buffer chamber communicating with the ink flow channels through the common liquid chamber, said ink-jet head being formed by joining said element substrate and said grooved member to each other, and wherein a direction perpendicular to a plane at which said buffer chamber opens in said common liquid chamber does not cross a direction of array of communication ports through which said ink flow channels communicate with said common liquid chamber; and an ink container for holding ink to be supplied to said ink-jet head.

13. An ink-jet head cartridge for performing recording by discharging an ink, comprising:

an ink jet head including: an element substrate having discharge energy generating elements for discharging said ink and disposed in ink flow channels, said element substrate further having bubble generating means for generating bubbles to be preserved in buffer chambers, the bubble generating means generating bubbles using heat; and a grooved member integrally having discharge openings through which said ink is discharged, grooves constituting said ink flow channels, a recess partly defining a common liquid chamber for commonly supplying said ink flow channels with said ink, and a recess defining a buffer chamber for preserving bubbles and communicating only and directly with said common liquid chamber, said buffer chamber communicating with the ink flow channels through the common liquid chamber; said ink-jet head being formed by joining said element substrate and said grooved member to each other, wherein the common liquid chamber has a side surface and an angle formed between said side surface of said common liquid chamber as viewed from the common liquid chamber and said substrate is grater than 40°; and an ink container for holding ink to be supplied to said ink-jet head.

14. An ink-jet head kit comprising:

an ink-jet head including: an element substrate having discharge energy generating elements for discharging said ink, and disposed in ink flow channels, said element substrate further having bubble generating means for generating bubbles to be preserved in bubble chambers, the bubble generating means generating bubbles using heat, a grooved member having discharge openings through which said ink is discharged; grooves constituting ink flow channels corresponding to said discharge openings, each said ink flow channel having a discharge energy acting portion in which discharge energy for discharging the ink acts on said ink; a recess partly defining a common liquid chamber for commonly supplying said ink flow channels with said ink; and a recess defining a buffer chamber for preserving bubbles and communicating only and directly with said common liquid chamber, said buffer chamber communicating with the ink flow channels through the common liquid chamber, said ink-jet head being formed by joining said element substrate and said grooved member to each other, and wherein a direction perpendicular to a plane at which said buffer chamber opens in said common liquid chamber does not cross a direction of array of communication ports through which said ink flow channels communicate with said common liquid chamber;

an ink container for holding ink to be supplied to said ink-jet head; and ink refilling means for refilling said ink container with said ink.

15. An ink-jet apparatus for performing recording by discharging an ink, comprising:

an ink-jet head including: an element substrate having discharge energy generating elements for discharging said ink, and disposed in ink flow channels, said element substrate further having bubble generating means for generating bubbles to be preserved in bubble chambers, the bubble generating means generating bubbles using heat, a grooved member having discharge openings through which said ink is discharged; grooves constituting ink flow channels corresponding to said discharge openings, each said ink flow channel having a discharge energy acting portion in which discharge energy for discharging the ink acts on said ink; an element substrate having discharge energy generating elements for discharging said ink, and disposed in ink flow channels, said element substrate further having bubble generating means for generating bubbles to be preserved in bubble chambers, the bubble generating means generating bubbles using heat, a grooved member having a common liquid chamber for commonly supplying said ink flow channels with said ink; and a recess defining a buffer chamber for preserving bubbles and communicating only and directly with said common liquid chamber, said buffer chamber communicating with the ink flow channels through the common liquid chamber, said ink-jet head being formed by joining said element substrate and said grooved member to each other, and wherein a direction perpendicular to a plane at which said buffer chamber opens in said common liquid chamber does not cross a direction of array of communication ports through which said ink flow channels communicate with said common liquid chamber; and activating means for activating said bubble generating means.

16. An ink-jet apparatus for performing recording by discharging an ink, comprising:

an ink-jet head including: an element substrate having discharge energy generating elements for discharging said ink and disposed in ink flow channels, said element substrate further having bubble generating means for generating bubbles to be preserved in buffer chambers, the bubble generating means generating bubbles using heat; and a grooved member integrally having discharge openings through which said ink is discharged, grooves constituting said ink flow channels, a recess partly defining a common liquid chamber for commonly supplying said ink flow channels with said ink, and a recess defining a buffer chamber for preserving bubbles and communicating only and directly with said common liquid chamber, said buffer chamber communicating with the ink flow channels through the common liquid chamber; said ink-jet head being formed by joining said element substrate and said grooved member to each other, wherein the common liquid chamber has a side surface and an angle formed between said side surface of said common liquid chamber as viewed from the common liquid chamber and said substrate is greater than 40°; and activating means for activating said bubble generating means.

* * * * *

UNITED STATES PATENT AND TRADEMARK OFFICE

CERTIFICATE OF CORRECTION

PATENT NO. : 6,109,734
DATED : August 29, 2000
INVENTOR(S) : Toshio Kashino et al.

It is certified that error appears in the above-identified patent and that said Letters Patent is hereby corrected as shown below:

Title page,
Item [75] Inventors: "Ishigorou Takahashi, deceased, late of Sakata, by Hiroto Takahashi, legal representative;" should read -- Hiroto Takahashi, deceased, late of Sakata, by Ishigorou Takahashi, legal representative; --; and Item [57],
Abstract,
Line 1, "ink jet" should read -- ink-jet --.

Column 4,
Line 31, "ink jet" should read -- ink-jet --;
Line 35, "ink jet" should read -- ink-jet --;
Line 39, "ink jet" should read -- ink-jet --.

Column 5,
Line 36, "element" should read -- elements --.

Column 7,
Line 61, "Based-on" should read -- Based on --.

Column 9,
Line 64, "is" should be deleted;
Line 66, "formed and ink filling opening 305." should read -- an ink filling opening 305 is formed. --.

Column 11,
Line 12, "head" should read -- heads --.

Column 13,
Line 33, "has" should read -- have --;
Line 42, "bubble" should read -- bubbles --.

Column 14,
Line 36, "was" should read -- were --.

Column 15,
Line 21, "was" should read -- were --.

UNITED STATES PATENT AND TRADEMARK OFFICE

CERTIFICATE OF CORRECTION

PATENT NO. : 6,109,734
DATED : August 29, 2000
INVENTOR(S) : Toshio Kashino et al.

It is certified that error appears in the above-identified patent and that said Letters Patent is hereby corrected as shown below:

Column 16,
Line 4, "cross-section" should read -- cross-section, --;
Line 59, "reciprocately" should read -- reciprocally --.

Column 17,
Line 17, "Numeral 5012" should read -- Numeral 5021 --.

Column 18,
Line 45, "reduce" should read -- reduced --.

Column 19,
Line 22, "an other" should read -- another --.

Column 20,
Line 35, "ink jet" should read -- ink-jet --;
Line 56, "grater" should read -- greater --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*